US008636154B2

(12) United States Patent
Chinn

(10) Patent No.: US 8,636,154 B2
(45) Date of Patent: Jan. 28, 2014

(54) LITTER SUPPORT SYSTEMS FOR MEDICAL CARE UNITS AND METHODS OF THEIR USE

(75) Inventor: Robert Chinn, Cumming, GA (US)

(73) Assignee: Ferno-Washington, Inc., Wilmington, OH (US)

( * ) Notice: Subject to any disclaimer, the term of this patent is extended or adjusted under 35 U.S.C. 154(b) by 391 days.

(21) Appl. No.: 12/834,187

(22) Filed: Jul. 12, 2010

(65) Prior Publication Data

US 2012/0006873 A1 Jan. 12, 2012

(51) Int. Cl.
*A47H 1/00* (2006.01)

(52) U.S. Cl.
USPC ... 211/103; 211/94.02; 211/101; 211/106.01; 248/240; 5/626

(58) Field of Classification Search
USPC ..... 211/103, 189–193, 94.02, 70.8, 101, 211/106.01, 187, 149, 150; 248/222.11, 248/222.12, 240, 250, 240.3, 240.4; 296/19, 24.33, 24.43; 244/118.6, 244/118.5; 5/118, 626; 280/748, 749
See application file for complete search history.

(56) References Cited

U.S. PATENT DOCUMENTS

| | | | | | |
|---|---|---|---|---|---|
| 269,985 | A | | 1/1883 | Adgate | |
| 619,174 | A | | 2/1899 | Haskins | |
| 716,852 | A | * | 12/1902 | Baker | 248/244 |
| 1,178,360 | A | | 4/1916 | Tudor | |
| 1,263,918 | A | * | 4/1918 | Miller | 296/19 |
| 1,288,010 | A | * | 12/1918 | Isaac | 108/147.17 |
| 1,576,034 | A | | 3/1926 | Butt | |
| 1,702,937 | A | * | 2/1929 | Friedemann | 248/243 |
| 1,817,962 | A | * | 8/1931 | Breuer | 248/308 |
| 2,391,051 | A | | 12/1945 | Windsor | |
| 2,456,024 | A | | 12/1948 | Schofield | |
| 2,473,364 | A | | 6/1949 | Dickinson et al. | |
| 2,480,322 | A | | 8/1949 | Cozzoli | |
| 2,556,076 | A | | 6/1951 | Evans et al. | |
| 2,644,591 | A | * | 7/1953 | McMahan | 248/220.41 |
| 2,685,912 | A | | 8/1954 | Evans et al. | |
| 3,042,221 | A | | 7/1962 | Rasmussen | |
| 3,204,998 | A | | 9/1965 | Stollenwerk | |
| 3,358,300 | A | | 12/1967 | Smith | |
| 3,375,936 | A | * | 4/1968 | Kessler | 108/108 |

(Continued)

FOREIGN PATENT DOCUMENTS

| | | |
|---|---|---|
| DE | 20 00 967 B1 | 7/1971 |
| DE | 3209092 A1 | 9/1983 |

(Continued)

OTHER PUBLICATIONS

International Search Report and Written Opinion dated Nov. 3, 2011, pertaining to International Application No. PCT/US2010/041724.

(Continued)

*Primary Examiner* — Korie H Chan
(74) *Attorney, Agent, or Firm* — Dinsmore & Shohl LLP.

(57) ABSTRACT

A litter support system for a vehicle, the litter support system comprising a support arm assembly for supporting a litter in a horizontal position, the support arm assembly including an adjustable hook assembly at a free end of the support arm assembly having an open position and a closed position, the adjustable hook assembly comprising a ratchet system that locks the hook assembly between the open position and the closed position.

33 Claims, 24 Drawing Sheets

(56) References Cited

U.S. PATENT DOCUMENTS

| | | | | | |
|---|---|---|---|---|---|
| 3,392,848 | A | * | 7/1968 | McConnell et al. | 211/192 |
| 3,591,121 | A | * | 7/1971 | Parris | 248/346.02 |
| 3,606,619 | A | * | 9/1971 | Stollenwerk | 5/9.1 |
| 3,613,900 | A | * | 10/1971 | Chiu | 108/106 |
| 3,770,234 | A | * | 11/1973 | Fovall | 248/117.7 |
| 3,840,265 | A | | 10/1974 | Stirling et al. | |
| 3,846,944 | A | * | 11/1974 | Lambert | 52/236.3 |
| 4,114,947 | A | * | 9/1978 | Nelson | 297/344.1 |
| 4,170,335 | A | * | 10/1979 | King | 248/246 |
| 4,178,032 | A | | 12/1979 | Hone | |
| 4,210,355 | A | | 7/1980 | Legueu | |
| 4,397,432 | A | * | 8/1983 | Resetar | 244/118.6 |
| 4,423,817 | A | | 1/1984 | Monjo-Rufi | |
| 4,425,978 | A | | 1/1984 | Star | |
| 4,458,864 | A | | 7/1984 | Colombo et al. | |
| 4,568,050 | A | * | 2/1986 | Radoy et al. | 248/223.41 |
| 4,576,319 | A | * | 3/1986 | Brown | 224/538 |
| 4,602,756 | A | * | 7/1986 | Chatfield | 248/223.41 |
| 4,915,435 | A | | 4/1990 | Levine | |
| 4,974,377 | A | | 12/1990 | Dominitz et al. | |
| 5,007,608 | A | * | 4/1991 | Carroll, Jr. | 248/297.21 |
| 5,383,629 | A | | 1/1995 | Morgan | |
| 5,490,703 | A | | 2/1996 | Hewko | |
| 5,615,848 | A | | 4/1997 | Ceriani | |
| 5,732,965 | A | * | 3/1998 | Willey | 280/288.4 |
| 5,738,306 | A | | 4/1998 | Moss et al. | |
| 5,755,478 | A | | 5/1998 | Kamiya et al. | |
| 5,779,296 | A | | 7/1998 | Hewko | |
| 5,785,277 | A | | 7/1998 | Manning et al. | |
| 5,813,629 | A | | 9/1998 | Cabrera | |
| 5,850,891 | A | * | 12/1998 | Olms et al. | 182/127 |
| 6,241,109 | B1 | * | 6/2001 | Kautz et al. | 211/192 |
| 6,273,366 | B1 | | 8/2001 | Sprenger et al. | |
| 6,585,188 | B2 | | 7/2003 | Alli | |
| 6,945,414 | B1 | * | 9/2005 | Stevens et al. | 211/94.01 |
| 7,097,204 | B2 | | 8/2006 | Jessup et al. | |
| 7,328,926 | B1 | * | 2/2008 | Myers et al. | 296/19 |
| 7,669,945 | B2 | * | 3/2010 | Blersch et al. | 312/408 |
| 7,677,400 | B2 | * | 3/2010 | Bayazit et al. | 211/26 |
| 2004/0178309 | A1 | | 9/2004 | Crowley et al. | |
| 2005/0039644 | A1 | | 2/2005 | Sheahan et al. | |
| 2008/0023976 | A1 | | 1/2008 | Myers et al. | |

FOREIGN PATENT DOCUMENTS

| | | | |
|---|---|---|---|
| DE | 3230905 | A1 | 2/1984 |
| DE | 89 10 460 | U1 | 10/1989 |
| EP | 0021526 | A2 | 1/1981 |
| EP | 0583491 | A1 | 2/1994 |
| FR | 2481110 | A | 10/1981 |
| FR | 2647323 | A1 | 11/1990 |
| FR | 2649007 | A1 | 1/1991 |
| GB | 1530794 | A | 11/1978 |
| GB | 2401541 | A | 11/2004 |
| WO | 9115178 | A1 | 10/1991 |
| WO | 9927881 | A1 | 6/1999 |
| WO | 0059446 | A1 | 10/2000 |

OTHER PUBLICATIONS

Extended European Search Report from EP Appln. No. 13163007.1 mailed Jun. 11, 2013.

Extended European Search Report from EP Appln. No. 1316300202 mailed Jun. 11, 2013.

* cited by examiner

LITTER SUPPORT SYSTEMS FOR MEDICAL CARE UNITS AND METHODS OF THEIR USE

CROSS-REFERENCE TO RELATED APPLICATIONS

This patent application claims priority to provisional Patent Application Ser. No. 61/224,743 filed Jul. 10, 2009.

TECHNICAL FIELD

This patent relates to litter support systems and methods of their use and, more particularly, to apparatus and methods for adjustable litter support systems for a medical care unit or a vehicle.

BACKGROUND

Injured or ill patients are many times carried and transported on litters. A litter generally refers to bed or stretcher that a person, such as a sick or wounded person, may be carried in or upon. Typically, a litter includes a supporting framework (e.g., cloth) supported by shafts. Rather than unload and load patients off and back on the litters while transporting them in emergency vehicles, the emergency personnel may often leave the patients on the litter and load both the patients and the litters directly into the emergency vehicle for and during transportation of the patients. Thus, there is a continued need for systems to support, manipulate, and secure litters within vehicles, particularly emergency vehicles. Additionally, there is a need for systems that can accommodate and secure litters of differing dimensions.

SUMMARY

In one embodiment a support arm assembly for a litter support system that is configured to support a patient in a horizontal elevated position is provided. The support arm assembly may include an arm portion including a free end and an attachment end, wherein the attachment end is configured to secure the support arm to an attachment structure for supporting the arm portion at a selected height, and an exterior hook disposed at the free end of the arm portion, wherein the exterior hook may be adjustable relative to the arm portion between open and closed positions to secure side shafts of various litters where the side shafts of the various litters have different diameters.

In another embodiment a litter support system may include a first vertical track including a first plurality of incremental securement locations and a first support arm including a first arm portion including a first free end and a first attachment end, wherein the first attachment end is configured to secure the first support arm to any of the first plurality of incremental securement locations. The litter support system may further include a second vertical track including a second plurality of incremental securement locations, the second vertical track being substantially parallel with the first vertical track, and a second support arm including a second arm portion including a second free end and a second attachment end, wherein the second attachment end is configured to secure the second support arm to any of the second plurality of incremental securement locations.

In yet another embodiment, a mounting track system for mounting equipment at various locations along a length of a mounting track is provided. The mounting track system may include a first vertical plurality of securement slots, wherein each securement slot includes an enlarged head portion adjacent a necked-down region, such that an enlarged head of a mounting projection may pass through the enlarged head portion to allow a neck connected to the enlarged head to slide down the necked-down region such that the enlarged head cannot be removed through the necked-down region. The mounting track system may further include a second vertical plurality of securement slots in parallel with the first vertical plurality of securement slots, where each of the second vertical plurality of securement slots are horizontally aligned with the first vertical plurality of securement slots such that the first vertical plurality of securement slots and the second vertical plurality of securement slots can simultaneously receive a pair of horizontally aligned mounting projections.

These and additional features provided by the embodiments described herein will be more fully understood in view of the following detailed description, in conjunction with the drawings.

BRIEF DESCRIPTION OF THE DRAWINGS

While the specification concludes with claims particularly pointing out and distinctly claiming the invention, it is believed the same will be better understood from the following description taken in conjunction with the accompanying drawings in which:

Figure 1:
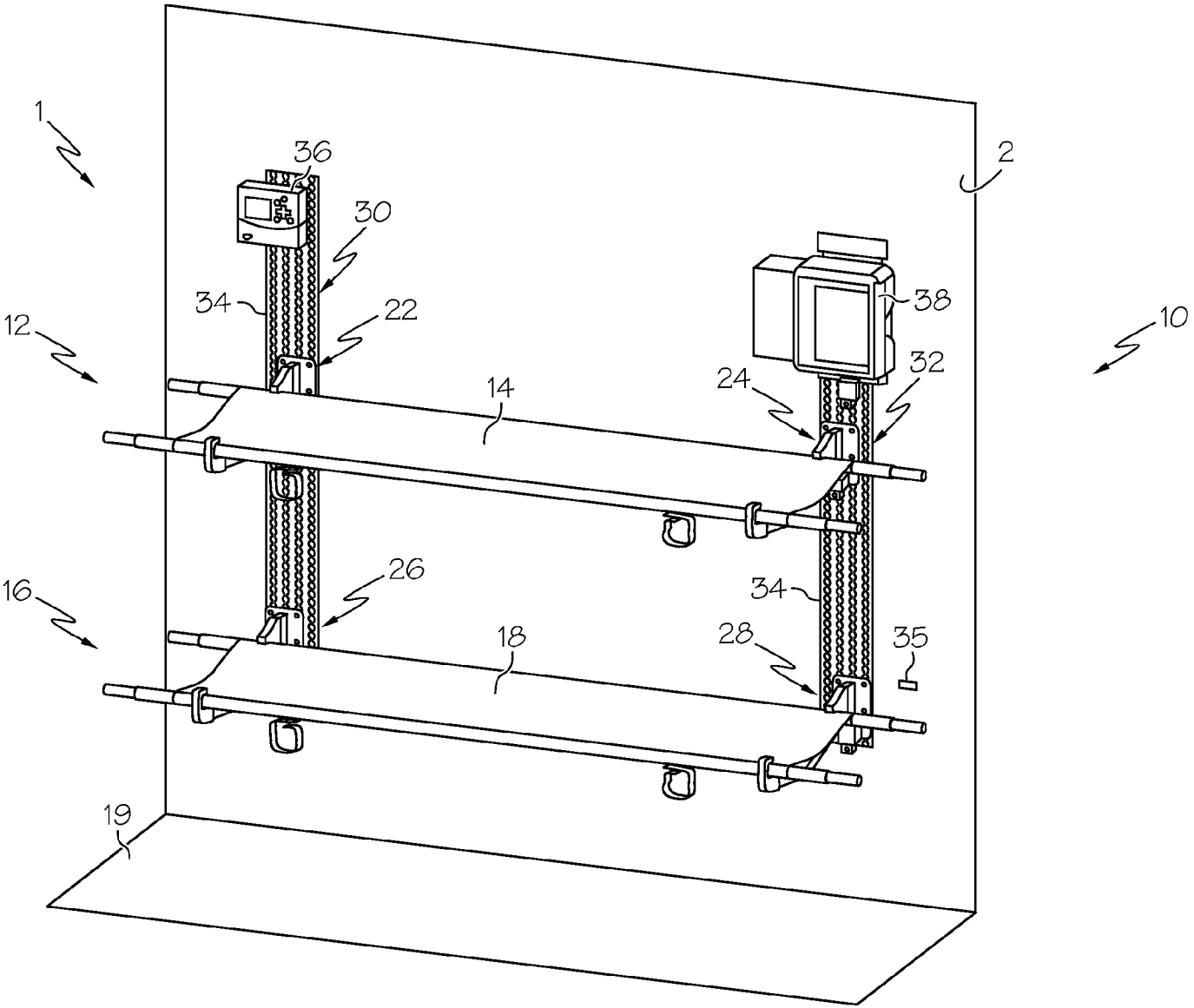
FIG. 1 is a perspective view of an exemplary embodiment of a litter support system in a fully deployed configuration.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 2:
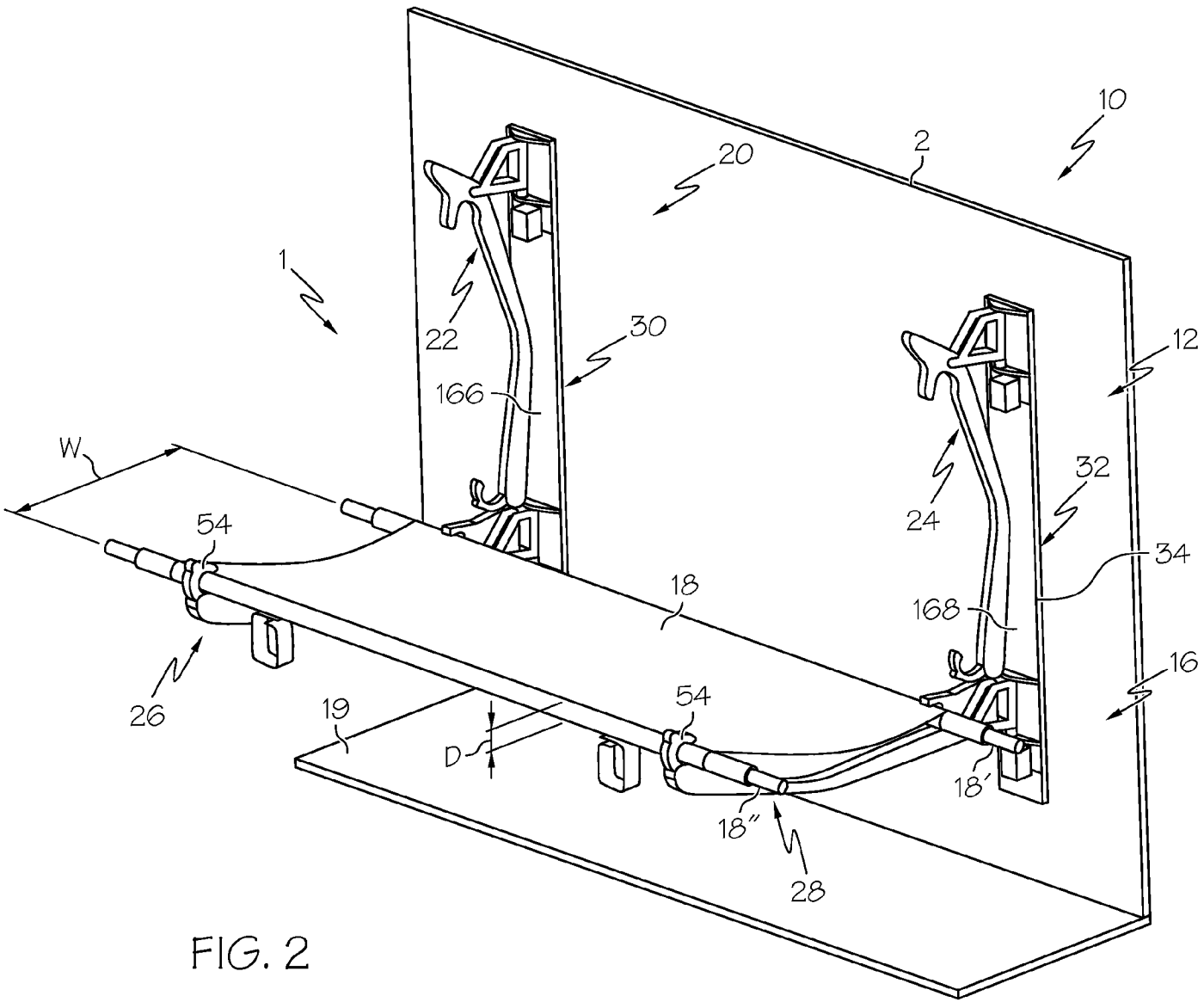
FIG. 2 is another perspective view of the exemplary litter support system of FIG. 1 in a stowed configuration.

Referring to FIGS. 1 and 2, an exemplary embodiment of a litter support system 10 is shown connected and/or mounted within a medical care unit 1. In one exemplary embodiment, medical care unit 1 comprises a vehicle, and thus, side wall 2 may be a wall within such vehicle. Exemplary vehicles may include, but not be limited to, ambulances or other ground vehicles, boats, airplanes, helicopters, or other emergency or support vehicles. In one exemplary embodiment, the litter support system 10 is connected and/or mounted to a military ground vehicle such as, for example, an armored military ground vehicle. For example, medical care unit 1 shown in FIG. 1 may be an armored truck suitable for transporting military personnel having wall 2.

In another exemplary embodiment, rather than a vehicle, medical care unit 1 may comprise a portable or fixed, container or building structure such that litter support system 10 may be connected and/or mounted to a side wall 2 of such container or building structure. In one exemplary embodiment, medical care unit 1 may a portable container that is transportable on or by a vehicle such as, for example, on a back of a truck or other road vehicle, on a trailer, within an aircraft, or any other vehicle, to a location, removed from the vehicle, and left at such location on a temporary or permanent basis to be used to provide medical care to patients such as injured military personnel. The container may comprise a bottom wall (i.e., a floor), multiple side walls (e.g., four side walls such as side wall 2), a top wall, and one or more doors for accessing the interior space of the container. Exemplary containers may comprise conventional metal storage and shipping containers used for shipping and storing of goods as known to one of ordinary skill in the art. The medical care unit 1 may comprise such a container as set forth above, wherein the container has been modified to function as a mobile and/or portable hospital or medical care unit that comprises any and/or all desired medical care equipment and supplies such that patients may be treated and/or housed within the medical care unit 1 (i.e. within the container). In one exemplary embodiment, the medical care unit's walls may be fortified with armored plating to provide added protection from gunfire, other weapons, and/or explosions. In another exemplary embodiment, medical care unit 1 may be a fixed building structure and/or a tent having at least one interior wall rigid enough to support litter support system 10 when mounted on such wall.

As will be described below, the litter support system 10 may provide a modular, adjustable litter support system, capable of planned or unplanned adjustments to accommodate a variety of emergency circumstances, whether foreseen or unforeseen. The litter support system 10 may provide a number of configurations for supporting one ore more litters carrying patients or other persons within vehicles and for stowing (see FIG. 2 illustrating an exemplary stowed configuration) or even removing components of the support system when not in use. The adjustability of the litter support system 10 may allow for accommodation of litters of various sizes (e.g., widths and thicknesses). The litter support system 10 may be modular in that a number of components of the litter support system may be interchangeable, which can reduce assembly time, complexity, and costs. Such modularity in the litter support system 10 may allow for a more rapid and fluid response to a particular emergency situation, which may improve medical outcomes in some instances. The litter support system configuration allows its use in a variety of different vehicles and/or other medical units, thus providing the benefit of interchangeability and flexibility.

The litter support system 10 may generally include an upper litter support assembly 12 upon which an upper litter 14 is supported, a lower litter support assembly 16 upon which a lower litter 18 is supported and a track system 20 that supports the upper and lower litter support assemblies 12 and 16 in their illustrated positions, spaced vertically from a floor 19 of the medical care unit 1. In the illustrated embodiment, the upper litter support assembly 12 supports the upper litter 14 above and substantially parallel to the lower litter 18. The upper litter 14 and the lower litter 18 are also shown as being oriented substantially parallel to the floor 19 of the medical care unit 1. Other orientations are possible, however. For example, one or both of the upper and lower litters 14 and 18 may be supported by their associated upper and lower litter support assemblies 12 and 16 in an inclined orientation, at an angle to the floor 19 of the medical care unit 1 and/or at an angle to each other.

The upper litter support assembly 12 may include a first upper support arm assembly 22 and a second upper support arm assembly 24, while the lower litter support assembly 16 may include a first lower support arm assembly 26 and a second lower support arm assembly 28. Each support arm assembly 22, 24, 26 and 28 may be separately adjustable along a height of the track system 20. In other embodiments, the upper support arm assemblies 22, 24 and/or the lower support arm assemblies 26, 28 may be linked such that their heights are adjustable together. As yet another example, the first upper and lower support arm assemblies 22, 26 and/or the second upper and lower support arm assemblies 24, 28 may be linked such that their heights are adjustable together. In many embodiments, each support arm assembly 22, 24, 26 and 28 is individually adjustable.

The track system 20 includes a first track 30 and a second track 32 spaced horizontally from the first track. Each track 30 and 32 may be substantially parallel and oriented vertically as shown, however, other orientations are possible, such as off vertical orientations. In some embodiments, for example, the first and second tracks 30 and 32 may have a horizontal orientation. In other embodiments, the track system 20 may comprise a first track spanning an entire wall in both the horizontal and vertical directions such that a mounting bracket may be removably attached to the track at any location along the wall. In yet another embodiment, the track may be mounted to the device that is to be secured to a wall while the wall comprises a plurality of projections for receiving the track. It should be appreciated that any other track location and configuration may further be realized. In one particular embodiment, slots 34 are provided in the first and second tracks 30 and 32. The slots 34 run vertically along the lengths of the first and second tracks 30 and 32 and provide locking structures for fixing a vertical position of the support arm assemblies 22, 24, 26 and 28. As can be seen, each first and second track 30 and 32 includes multiple, horizontally spaced-apart slots 34. While four slots 34 are illustrated per track 30 and 32, there may be more or less than four slots, such as three slots. A three slot configuration will be described in detail below.

In some embodiments, printed or painted indicia 35 may be used along with the track system 20. For example, a height indicator may be placed alongside or even on the tracks 30 and 32. In some embodiments, a marker may be placed along a height of the tracks 30 and 32 to allow for rapid adjustments of the support arm assemblies 22, 24, 26 and 28. The indicia may be located on the tracks 30 and 32 and/or on the wall 2.

It should be noted that while two litter support assemblies 12 and 16 are illustrated in FIG. 1, there may be more or less than two litter support arm assemblies per track system 20. Additionally, there may be more than one litter support system 10 in the vehicle. For example, multiple litter support systems 10 may be mounted at various locations within the medical care unit 1.

Figure 27:
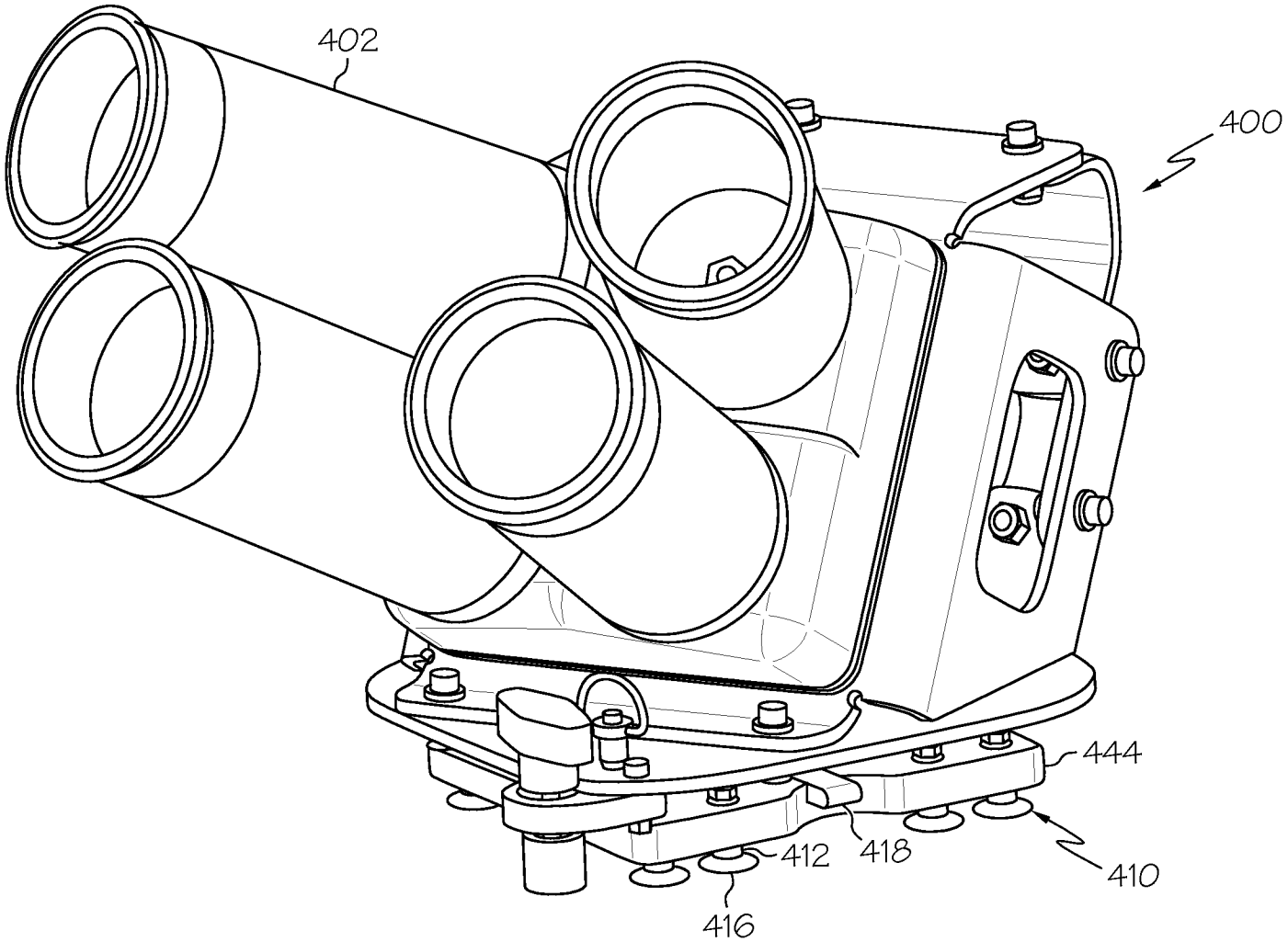
FIG. 27 is a perspective view of a smoke grenade launching system that can be mounted to a track.

Various components other than the support arm assemblies 22, 24, 26 and 28 may be supported by the track system 20. In some embodiments, a monitor 36 (e.g., for monitoring vital signs) may be supported on the first track 30, while a different medical device 38, such as another monitor or other device such as an infusion pump apparatus, IV bag, lighting systems, etc., may be supported on the second track 32. Any number of medical related devices or non-medical devices may be supported on the track system 20. The various monitoring components, such as the monitor 36, may be wired or wireless (e.g., using Bluetooth technology). In some instances, it may be useful to locate the monitor 36 and device 38 closer to the litter support assembly 12 and 14 carrying the patient that is using the monitor 36 and the device 38. For example, in FIG. 1, the monitor 36 and device 38 are located above the upper litter support assembly 12 for use in monitoring a patient located on the upper litter support assembly. In another configuration, the monitor 36 and the device 38 may be located between the upper litter support assembly 12 and the lower litter support assembly 14 for use in monitoring a patient located on the lower litter support assembly. In other embodiments, such as where the track system 20 is disposed on the exterior of a vehicle, auxiliary support equipment may also be mounted to the track system 20. For example, referring to FIG. 27, a smoke grenade launching system 400 comprising a plurality of launch tubes 402 may be mounted to the exterior of the vehicle. As will become appreciated herein, the smoke grenade launching system 400, or any other auxiliary support equipment, may be secured to a mounting bracket 444 comprising a plurality of projections 410. Each projection 410 can comprise a stem portion 412 and a head portion 416 such that the mounting bracket 444 allows for quick modular installation along any section of track. In addition, the mounting bracket 444 can comprise a lever 418 used to release the mounting bracket 444 from the track to enable a quick release of equipment from a vehicle as may become necessary during operation.

Figure 3:
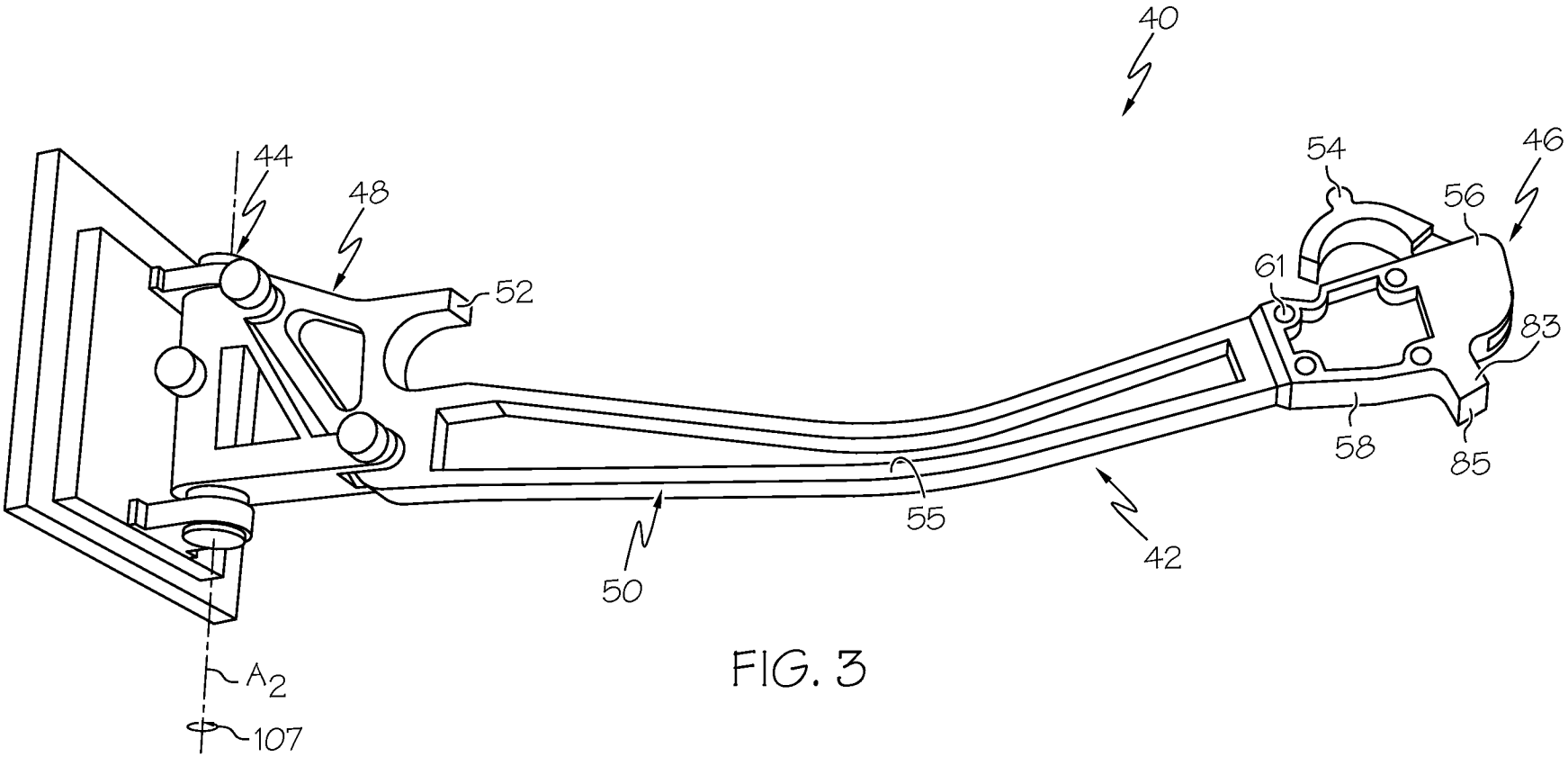
FIG. 3 is a side view of an exemplary embodiment of a support arm assembly for use in the litter support system of FIG. 1.

Referring to FIG. 3, an embodiment of a support arm assembly 40 for use in any one or both of the upper litter support assembly 12 and the lower litter arm support assembly 16 may generally include a support arm 42 and a mounting bracket 44. The support arm 42 has a terminal, free end 46, an attachment end 48 that is mounted to the mounting bracket 44 and an elongated arm portion 50 that extends between the free end 46 and the attachment end 48. A first hook 52 (i.e., an interior hook) may be located at the attachment end 48 of the support arm assembly 40. The first hook 52 may be fixed relative to the arm portion 50 and be sized and located to receive a side shaft of a litter. A second hook 54 (i.e., an exterior hook) may be located at the free end 46 of the support arm assembly 40. The second hook 54 may be sized and located to receive an opposite side shaft of the litter. In some embodiments, the elongated arm portion 50, the first hook 52 and the attachment end 48 of the support arm assembly 40 may be formed together as a single piece, such as by casting a metal material (e.g., aluminum, steel, etc.). As can be seen, the arm portion 50 may have a bend 55 toward a center of the arm portion. The bend 55 may be shaped to reduce any interference between the arm portion 50 and spreader bars of the litter (i.e., curved bars running between the side rails of the litter). The free end 46 may include an assembly of plates 56 and 58 that sandwich and connect the free end 46 to the elongated arm portion 50. Any suitable connecting structure or method may be used to connect the plates 56 and 58 together, such as by fasteners 61, welding, etc.

Figure 4:
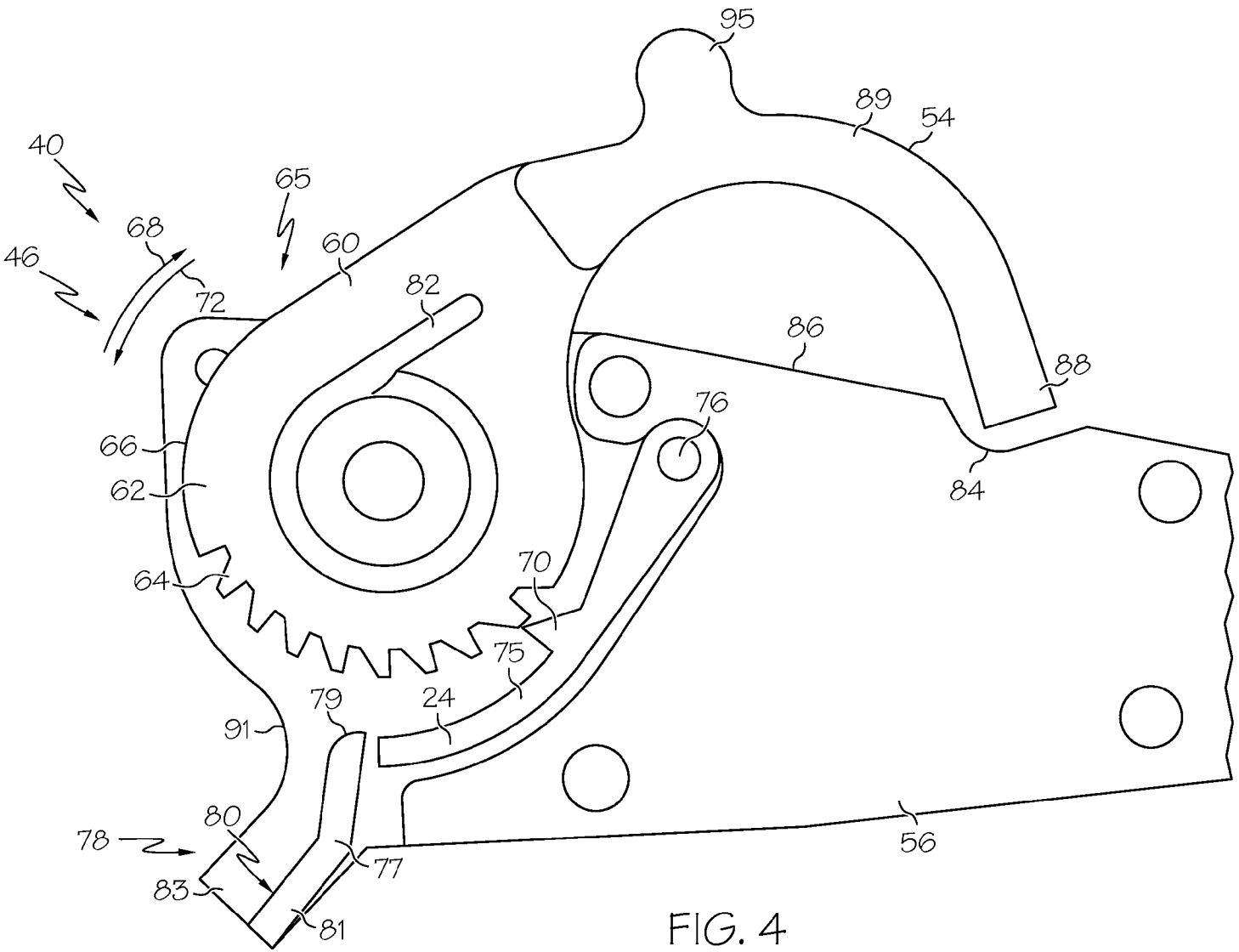
FIG. 4 is a detail view of an end of the exemplary support arm assembly of FIG. 3 with an end plate removed.

Referring now to FIG. 4 showing the free end 46 of the support arm assembly 40 with plate 58 removed, the second hook 54 may be part of an adjustable hook assembly 65 that is at least partially housed between the plates 56 and 58. The adjustable hook assembly 65 includes the second hook 54, which may be attached to a ratchet 60 including a gearwheel 62 with teeth 64 located about a periphery 66 of the ratchet. In the illustrated embodiment, the teeth 64 may be slanted at an angle so that when the teeth are moving in the direction of arrow 68 (i.e., the closing direction), a pawl 70 slides up and over each tooth in turn. When the teeth 64 are moving in the direction of arrow 72 (i.e., the opening direction), the angles of the pawl 70 and the teeth 64 cause the pawl to catch against a tooth 64 and stop further motion in that direction.

The pawl 70 may be biased toward the gearwheel 62 (e.g., by a spring) and is located on a trigger 74, which is pivotally connected to the free end 46 at pivot 76. The trigger 74 has a curved portion 75 with the pawl 70, a downward portion 77 connected to the curved portion by a bend 79 and a slanted portion 81 at an angle to the downward portion. An access location 78 may be provided at the free end 46 between guard members 83 and 85 that may be part of the plates 56 and 58 (see FIG. 3) to allow an operator to move (e.g., depress) the trigger 74 and the pawl 70 in the direction of arrow 80 out of engagement with the gearwheel 62. The ratchet 60 may be biased toward the open position (e.g., using a spring 82). When the trigger 74 and associated pawl 70 are moved out of engagement with the gearwheel 62, the ratchet 60 and associated second hook 54 may move in the opening direction of arrow 72 due to the bias provided by the spring 82.

The ratchet 60 and the second hook 54 are pivotable between the closed position and the open position and can be locked at multiple positions between the closed position and the open position due to the interaction between the gearwheel 62 and the pawl 70. A notch 84 extends inwardly from an upper surface 86 of the free end 46 that is sized to receive an end 88 of the second hook 54 with the second hook in the closed position. The notch 84 allows the end 88 of the second hook 54 to be located beneath the upper surface 86 and sheathed within the notch, which can reduce the possibility of snagging the second hook 54 unintentionally due to an exposed hook end 88.

Figure 5:
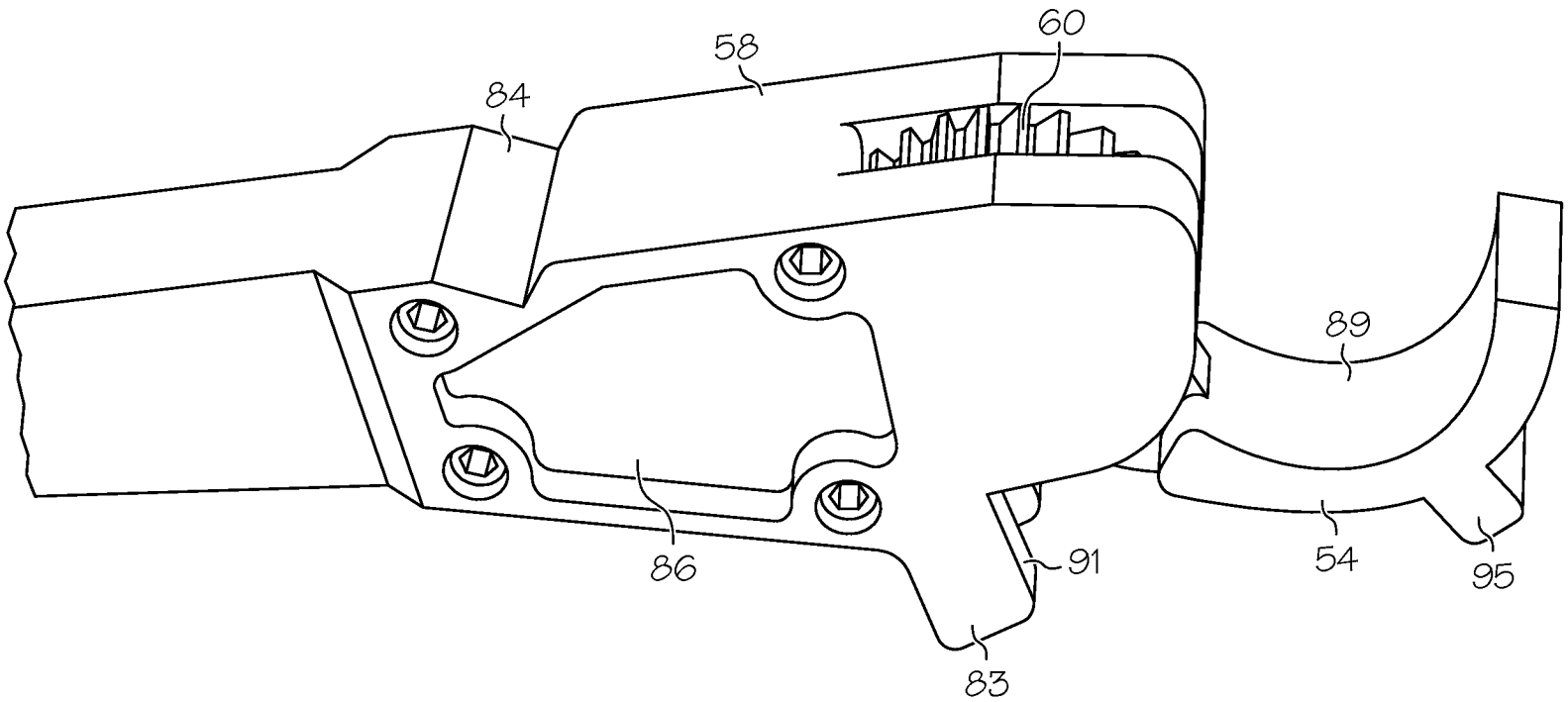
FIG. 5 is a detail view of the end of the exemplary support arm assembly of FIG. 3.

Referring also to FIG. 5, a view of the second hook 54 is shown in the open position. In one embodiment, the periphery 66 of the ratchet 60 may come into contact with the bend 79 of the trigger 74, which serves as a stop surface for stopping rotation of the second hook 54 in the open position shown. As another example, the second hook 54 may have an increased thickness at crook portion 89 that is greater than an interior distance between the plates 56 and 58. Surfaces (only surface 91 can be seen) of the guard members 83 and 85 may serve as stop surfaces to prevent rotation of the second hook 54 once in the closed position. Other suitable stop arrangements may also be employed to stop rotation of the second hook beyond a desired open position. In some embodiments, a projection 95 may be provided on the crook portion 89 of the second hook 54. The projection 95 may provide a location for controlling movement of the second hook 54, e.g., using a thumb.

With the ratchet 60 and pawl 70, the adjustable hook assembly 65 may be operated with only one hand, which may free the other hand to engage in other tasks. By separating the pawl 70 from the gearwheel 62, the biased ratchet 60 can open without any force in addition to that provided by the spring 82 as long as the pawl remains separated from the gearwheel 62. Once the ratchet 60 and second hook 54 are in the open position, the ratchet and the second hook can be rotated toward the closed position with the same trigger-operating hand. The teeth 64 and the pawl 70 are slanted at an angle so that when the teeth are moving in the closed direction, the pawl slides up and over each tooth in turn and the spring associated with the pawl forces the pawl back into an adjacent depression before the next tooth until the second hook 54 grasps the shaft of the litter or reaches the closed position. Once the second hook 54 grasps the shaft of the litter, the ratchet 60 and pawl 70 prevents opening of the second hook due to the locking arrangement between the ratchet and the pawl. As best illustrated in FIG. 2, in embodiments where the second hook 54 is adjustable between open and closed positions, the litter support assembly 16 may be operable to secure side shafts 18', 18" of various litters 18 where the various litters 18 have different widths W and/or the side shafts 18', 18" of the various litters have different diameters D. For example, where two litters 18 have slightly different widths W (i.e., the distance between the side shafts 18', 18"), or comprise side shafts 18', 18" with slightly different diameters D, such as a result of different manufacturing origins, the same support arm assemblies 26, 28 may be operable to support either litter due to the adjustable second hook 54 being operable to adjustably secure side shafts of different configurations and in different positions.

Figure 24:
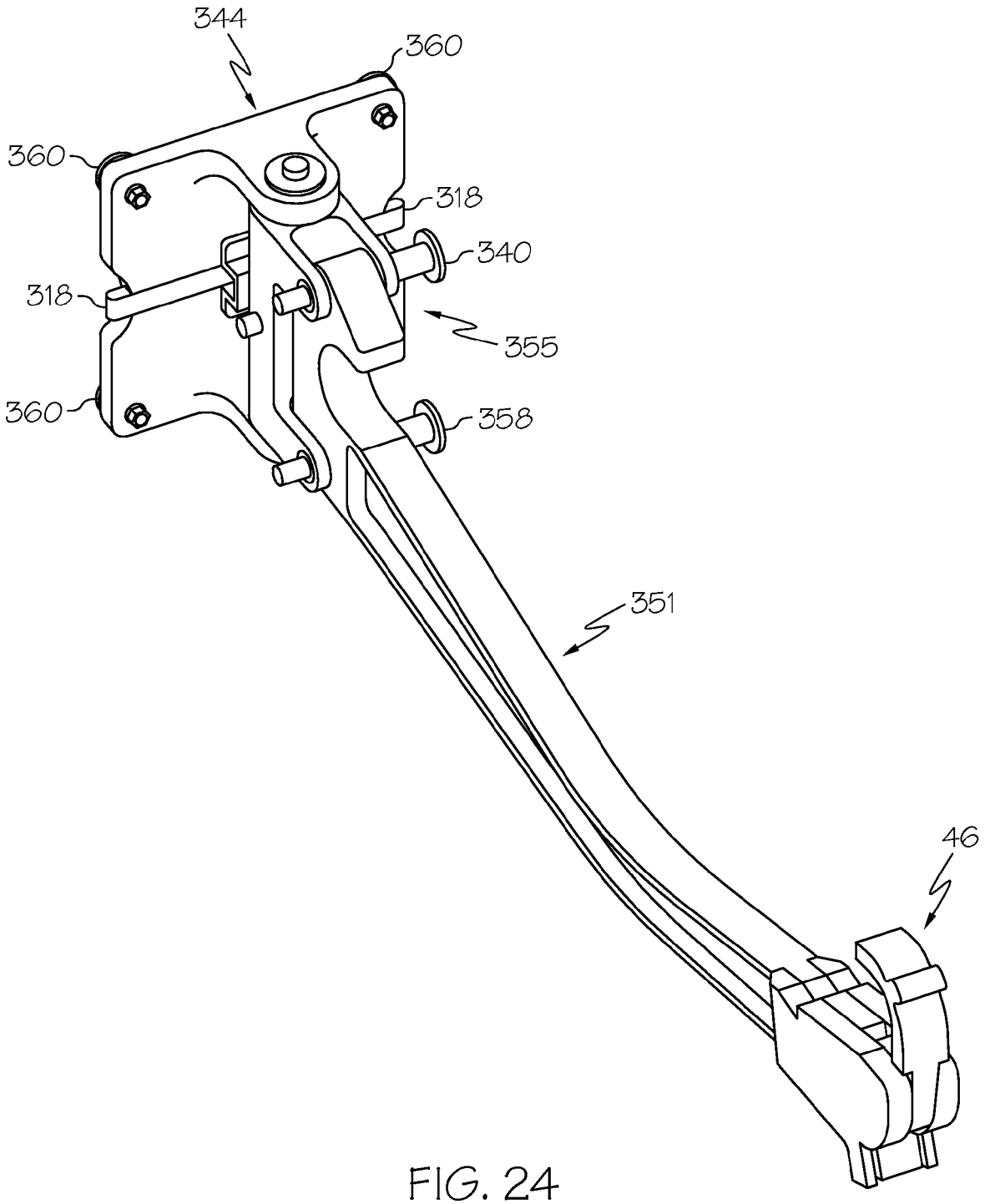
FIG. 24 is a side view of another exemplary embodiment of a support arm assembly for use in the litter support system of FIG. 1.
Figure 25:
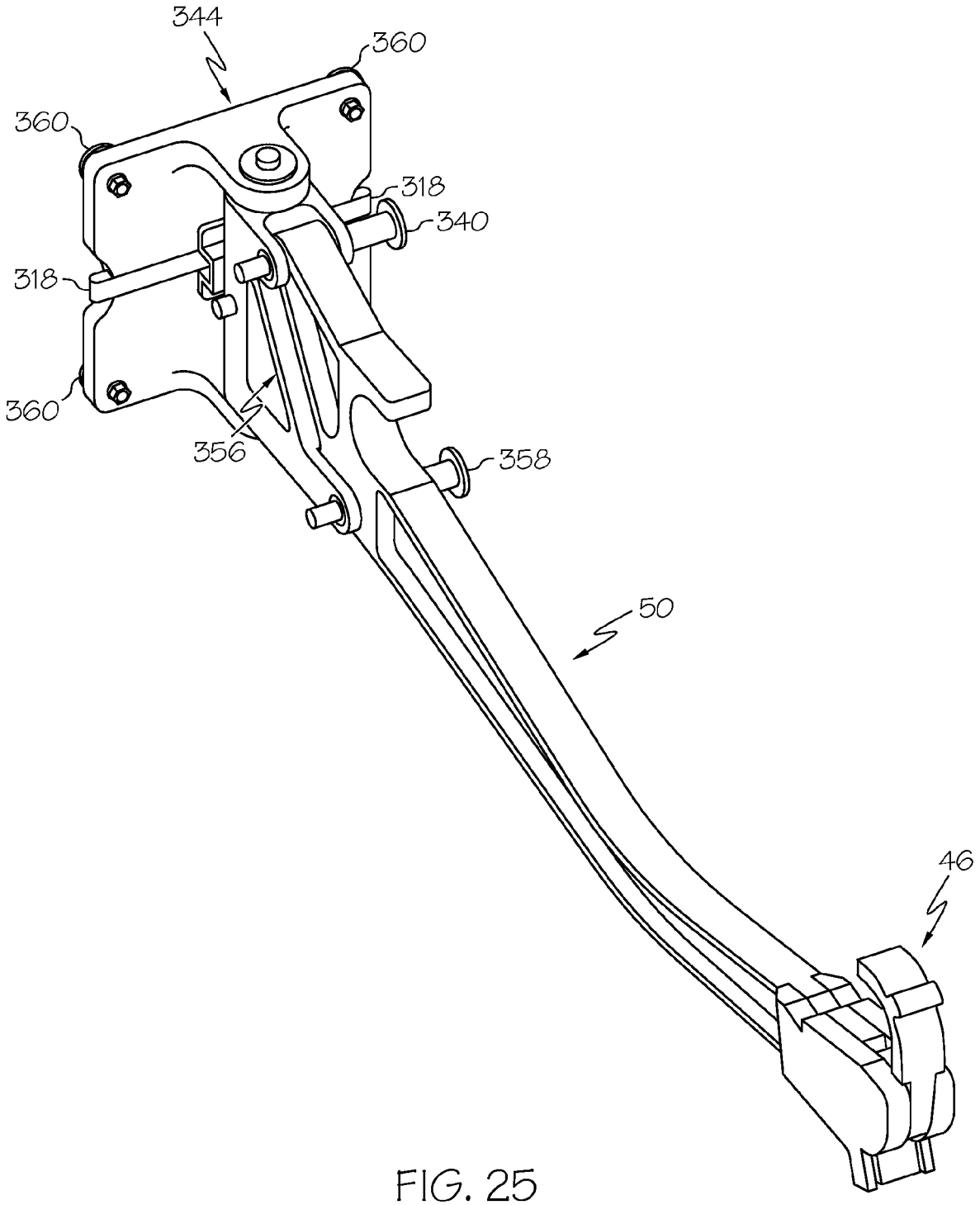
FIG. 25 is a side view of another exemplary embodiment of a support arm assembly for use in the litter support system of FIG. 1.
Figure 26:
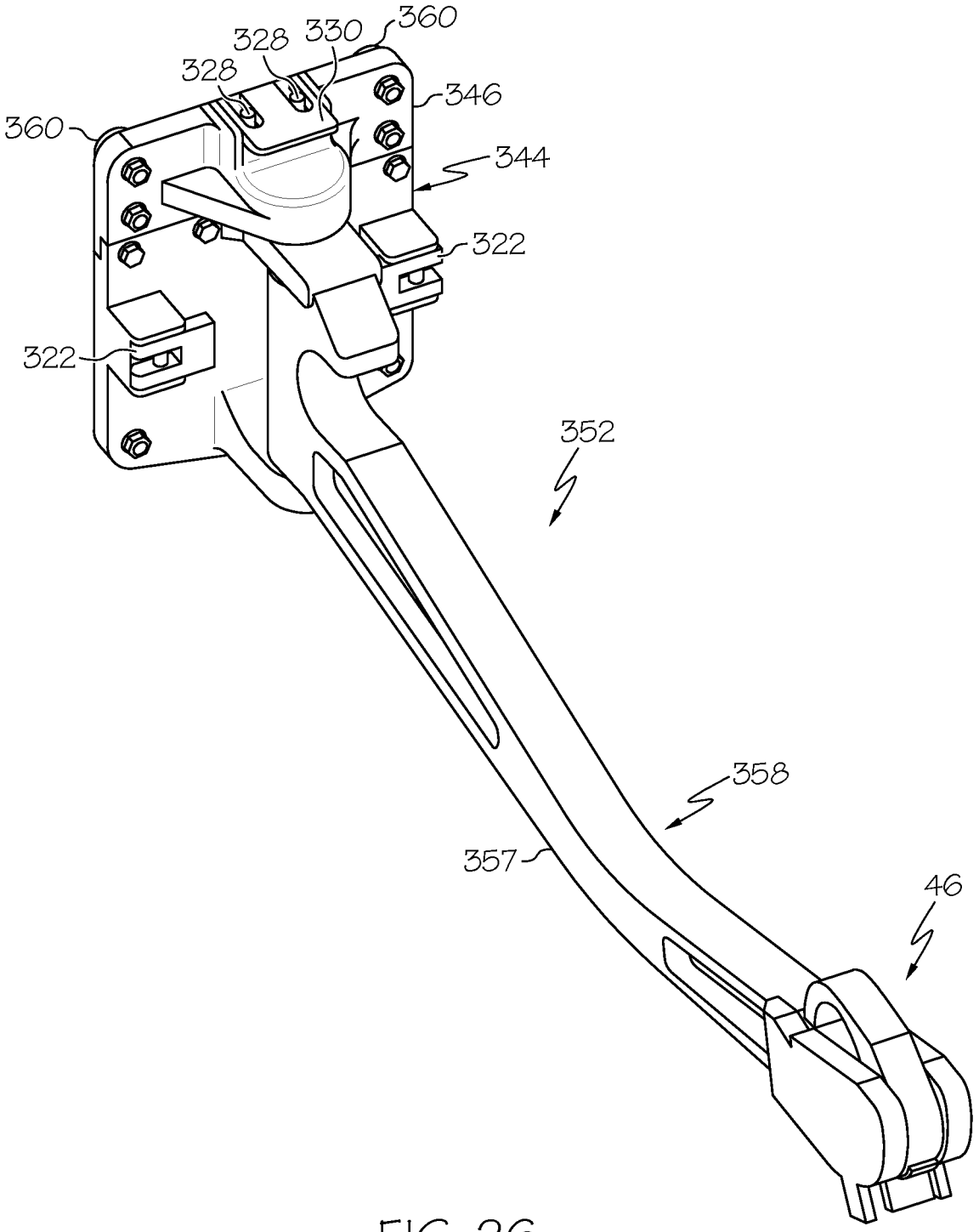
FIG. 26 is a side view of another exemplary embodiment of a support arm assembly for use in the litter support system of FIG. 1.

The mounting arm and mounting bracket may comprise a variety of configurations that allow for supporting a litter thereon. For example, referring to FIG. 24, in one embodiment, the support arm may comprise a horizontally low profile arm portion 351 that supports the litter closer to the wall and thereby limits the amount of space in the horizontal direction needed for the overall assembly. In such an embodiment, horizontally low profile mounting arm may comprise an interior hook assembly 355 without additional framework allowing the interior hook assembly 355 to be disposed closer to the wall. Pins 340 and 358 may then secure the horizontally low profile arm portion 351 to the mounting bracket 344 while multiple projections 360 secure the mounting bracket 344 to a wall until two release levers 318 are actuated as will become appreciated herein. Referring to FIG. 25, in another embodiment, the arm portion 50 may not comprise a low profile design but rather include additional trusses 356 for added support. The additional trusses 356 may allow for the arm portion 50 to support heavier loads. Referring to FIG. 26, in yet another embodiment, the support arm may comprise an alternative low profile arm portion 352 that provides for support of a litter in close proximity with a wall but still allows for supporting heavy loads by providing one or more trusses 357 along the length of the low profile arm portion 352. Furthermore, the mounting bracket 344 may provide additional projections 360 to provide additional support when carrying such heavy loads. In some embodiments, such as illustrated in FIG. 26, the arm portion 352 may further comprise a recession 358 between the mounting bracket 344 and the second hook 46. The recession 358 may provide a recess or dip in the arm portion 352 to accommodate litters with greater depths. For example, where a litter comprises a cross bar that bends downwardly towards the center, the recession 358 may accommodate the bent cross bar when a relatively straight arm portion 352 could not.

Referring back to FIG. 3, the mounting bracket 44 provides various pivot structures that allow support arm 42 to pivot relative to the mounting bracket 44. In some embodiments, the support arm 42 may be capable of pivoting up and down about axis $A_1$ in the direction of arrows 100 and side to side about axis $A_2$ in the direction of arrow 102.

Figure 6:
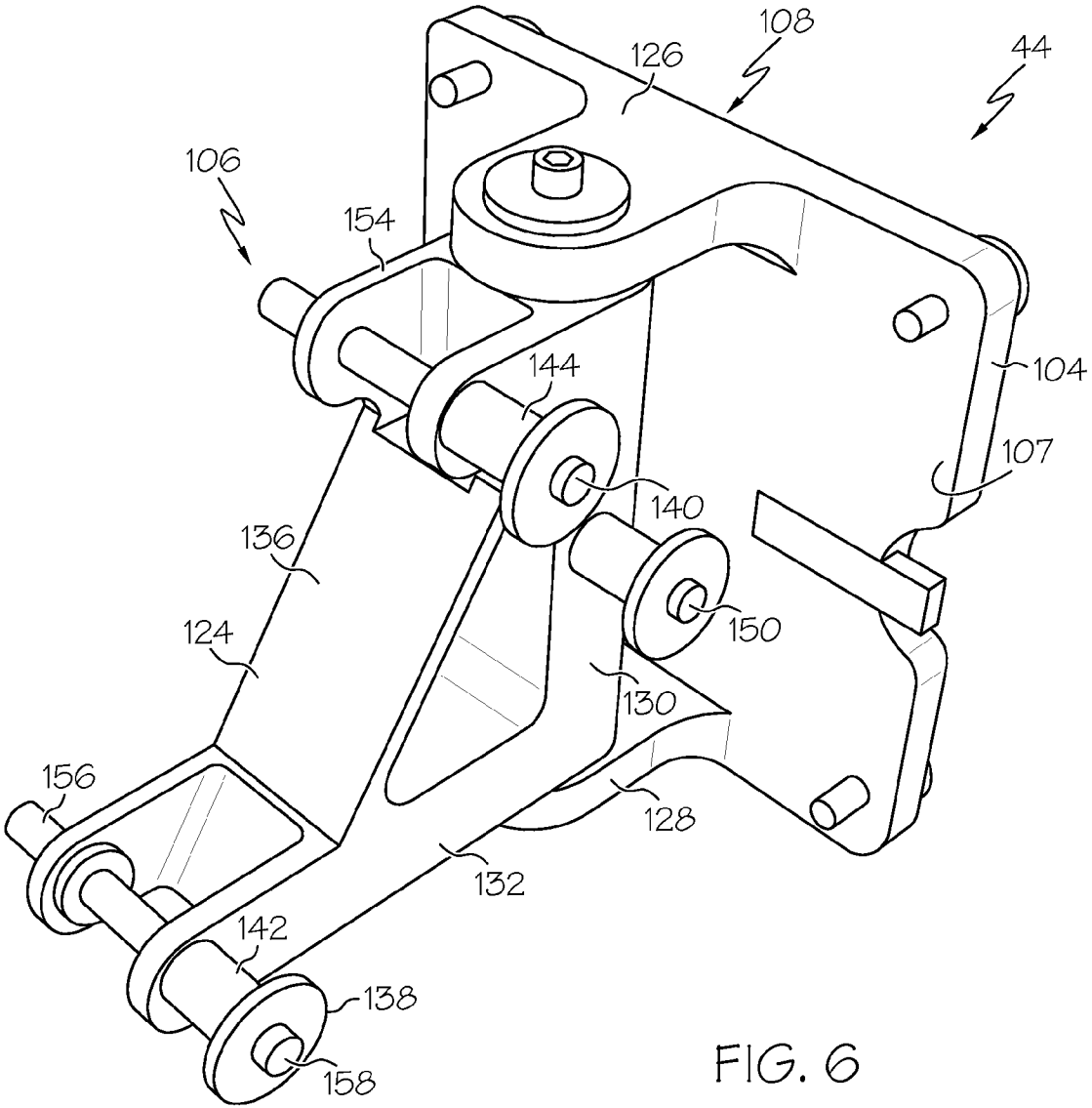
FIG. 6 is a perspective view of an exemplary embodiment of a mounting bracket for use with the support arm assembly of FIG. 3.
Figure 7:
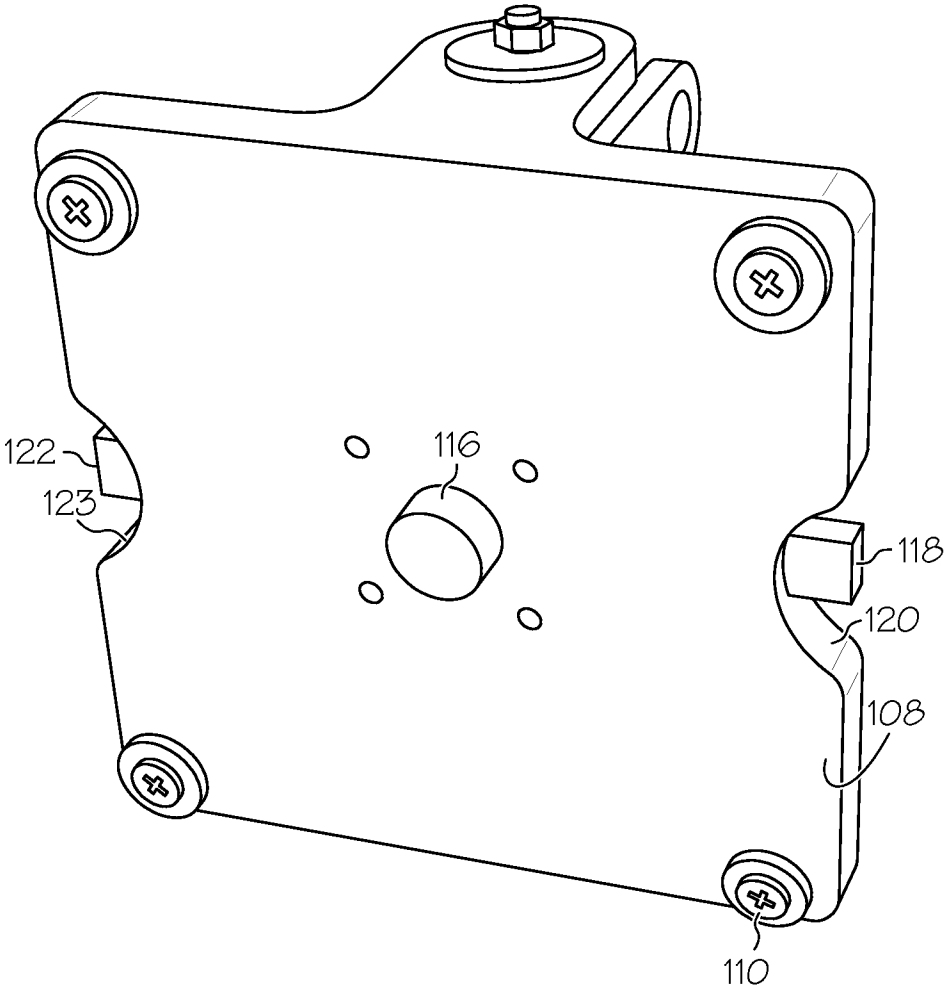
FIGS. 7 and 8 are bottom views of the exemplary mounting bracket of FIG. 6.
Figure 8:
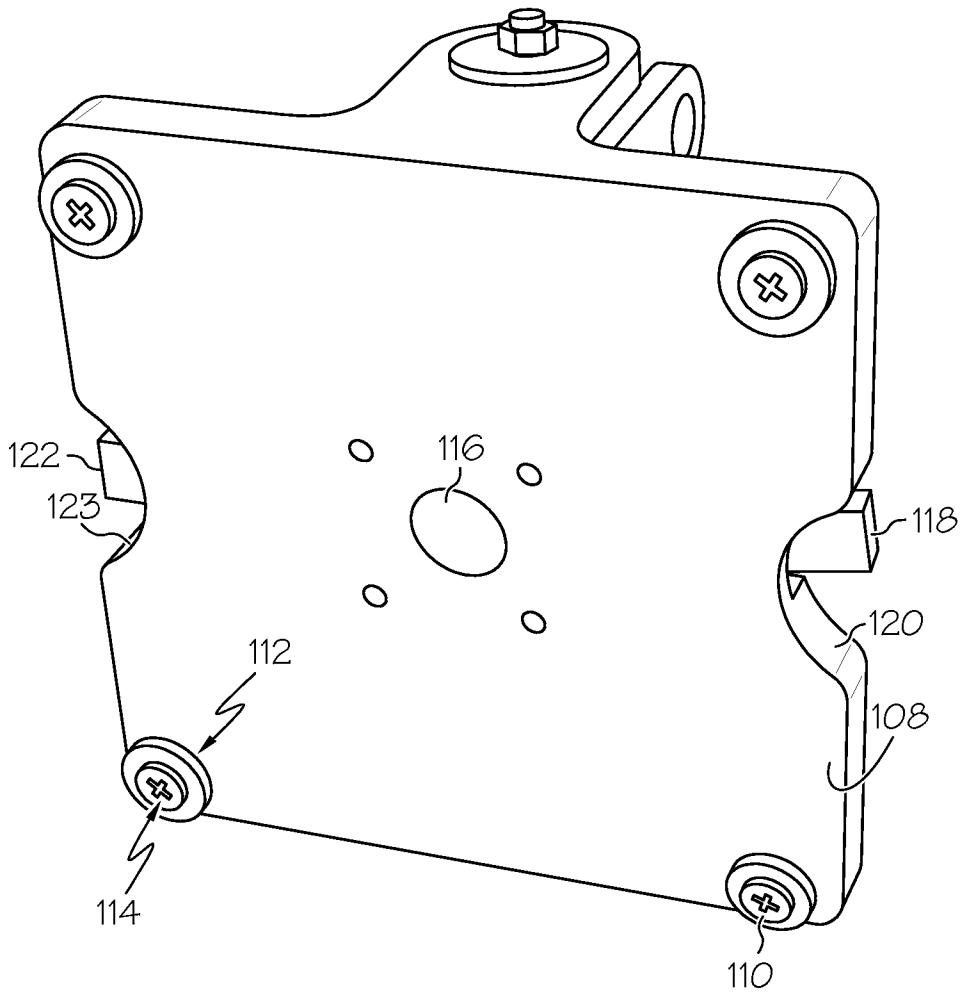

Referring also to FIGS. 6-9 illustrating the mounting bracket 44 with the support arm 42 removed, the mounting bracket includes a mounting plate 104 and a swivel bracket assembly 106 mounted thereto. The mounting plate 104 includes an outer surface 107 facing away from the wall to which it is mounted and an inner surface 108 facing toward the wall to which it is mounted. Referring particularly to FIGS. 7 and 8, at the inner surface 108 are projections 110 that can be received within the slots 34 of the tracks 30 and 32 (FIG. 1). Each projection 110 includes a stem portion 112 and an enlarged head portion 114. As will be described in greater detail below, the head portions 114 are sized to be received through enlarged open regions of the slots 34 and to be captured behind necked-down regions of the slots, while the stem portions are sized to pass by the necked-down regions of the slots.

A locking projection 116 may be provided at the inner surface 108. The locking projection 116 may be biased (e.g., by a spring) toward an extended, lock position for engaging the associated track 30, 32 and locking the support arm assembly at a vertical position along the track 30, 32. The locking projection 116 may be retracted using a lever 118 operatively connected to the locking projection that can be moved away from the outer surface 107 manually. The extended position of the locking projection 116 is illustrated by FIG. 6 and the retracted position of the locking projection is illustrated by FIG. 7. As can be seen, a recessed access region 120 is provided for increased access to the lever. In some embodiments, a second lever 122 (and recessed region 123) may be provided at an opposite side of the mounting plate 104 in connection to the same locking pin or an additional locking pin to either allow the operator a choice in which lever 118 and 122 to use to retract the locking projection 116, for example, depending on accessibility of the levers 118 and 122 or to provide additional security before the mounting plate 104 can be released. For example, referring to FIGS. 21-25, in one embodiment a mounting bracket 344 may comprise a locking projection 320 that can only be retracted (to unlock the mounting bracket) when a lever 318 is actuated on both sides of the mounting bracket 344. Such an embodiment may provide for additional security by preventing unwanted movement of the mounting bracket when a single lever is accidentally actuated.

Figure 9:
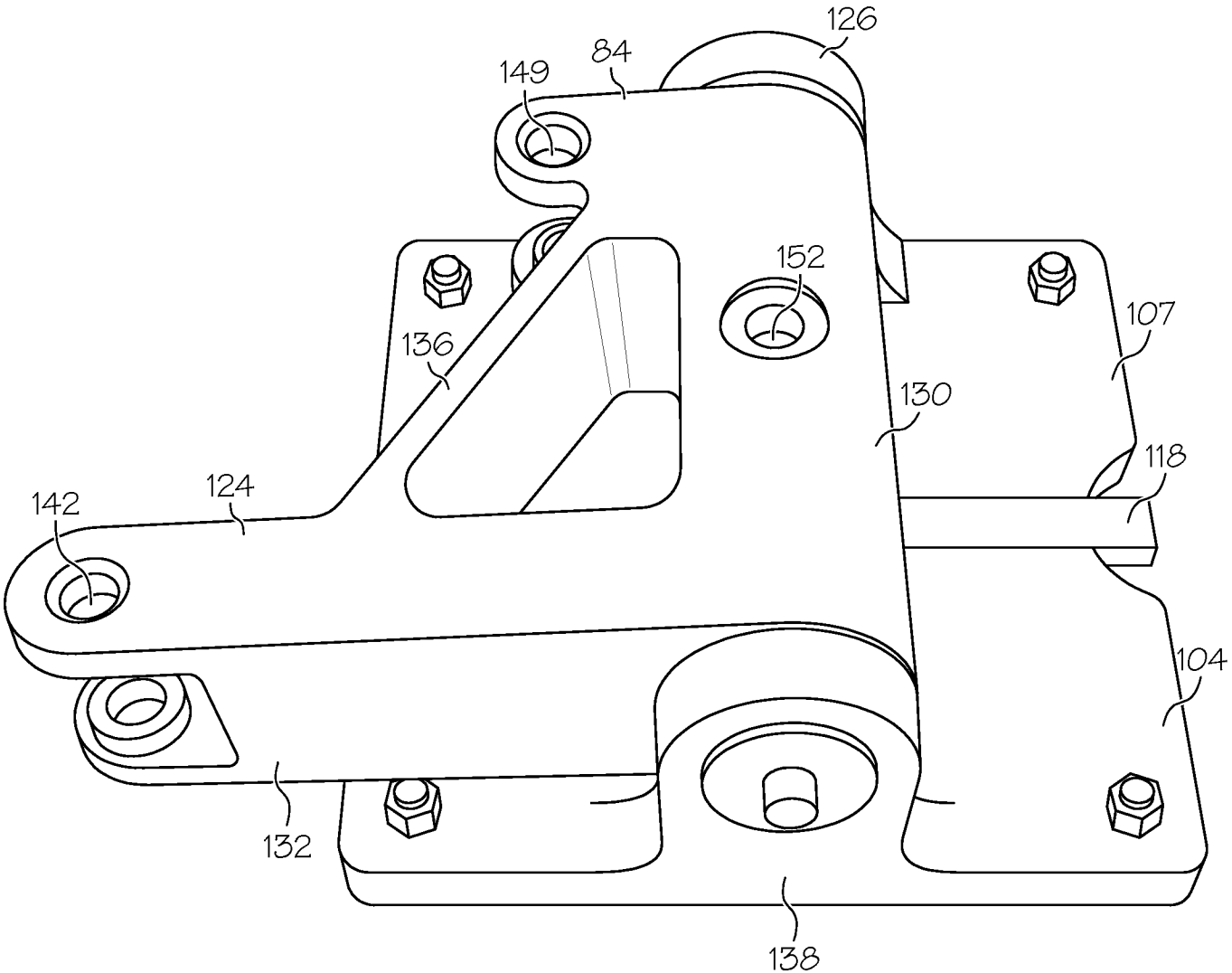
FIG. 9 is a perspective view of the exemplary mounting bracket of FIG. 6.

Referring now to FIGS. 6 and 9, the swivel bracket assembly 106 includes a pivot bracket 124 that is pivotally mounted to internal shaft that extends between two shaft mount arms 126 and 128. In some embodiments, the shaft mount arms 126 and 128 extend integrally outward from the outer surface 107 of the mounting plate 104. The pivot bracket 124 includes a vertical pivot member 130 having an opening extending therethrough that slidingly receives the internal shaft of the shaft mount arms 126 and 128. A lower arm support member 132 extends outwardly and integrally from the vertical pivot member 130 near the shaft mount arm 128. An upper arm support member 134 extends outwardly and integrally from the vertical pivot member 130 near the shaft mount arm 126. A cross bar 136 may extend from the lower arm support member 132 to the vertical pivot member 130 to provide additional load-bearing support for the lower arm support member.

Figure 10:
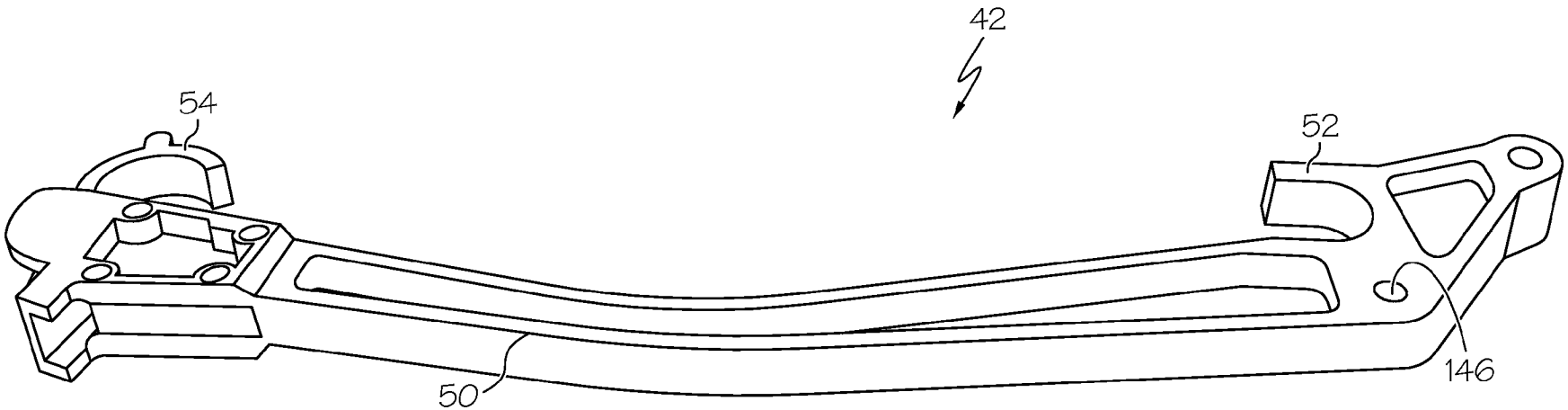
FIG. 10 is a perspective view of an exemplary embodiment of a support arm for use with the support arm assembly of FIG. 3.
Figure 11:
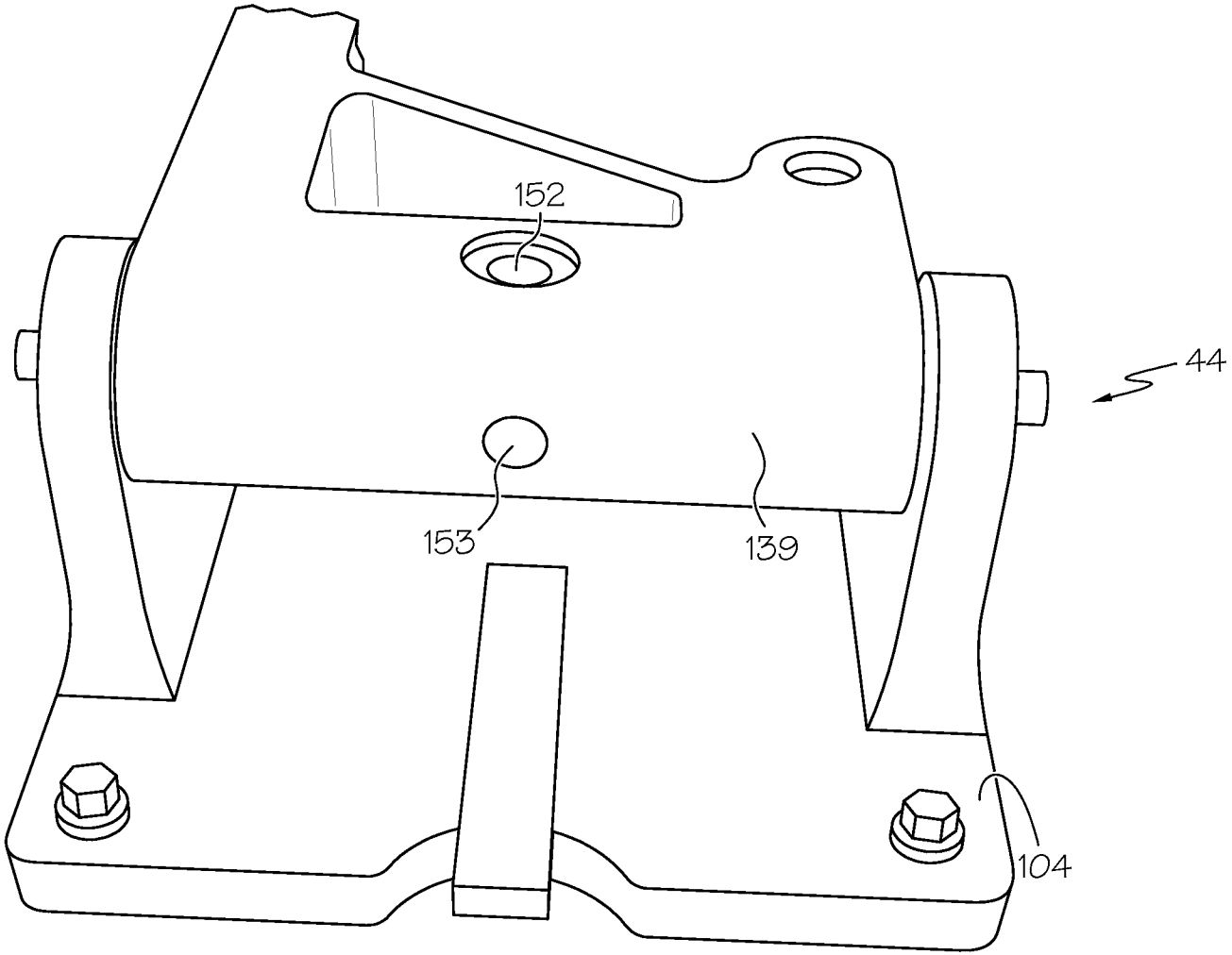
FIG. 11 is a side view of the exemplary mounting bracket of FIG. 6.

Pins 138 and 140 may be provided to connect the support arm 42 to the pivot bracket 124 (see FIG. 3 also). The pins 138 and 140 may be removably received by openings 142 and 144 in the lower arm support member 132 and the upper arm support member 134, respectively. The support arm 42 has corresponding openings (see FIG. 10 illustrating opening 146) that align with the openings 142 and 144 in the lower and upper arm support members 132 and 134. Another pin 150 may be provided for locking the pivot bracket 124 relative to the mounting plate 104 thereby preventing rotation of the pivot bracket. Aligned openings (only opening 152 can be seen in FIG. 9) are provided in the vertical pivot member 130 and internal shaft for inserting the pin 150 therethrough. In some embodiments, the internal shaft may include multiple openings for locking the pivot bracket 124 in multiple positions such as the position of FIG. 6 and the position of FIG. 9. FIG. 9 illustrates the pivot bracket 124 pivoted toward a side of the mounting plate 104 while FIG. 6 illustrates the pivot bracket 124 locked in a forward position. As another embodiment, referring to FIG. 11, the vertical pivot member 130 may include multiple openings (see also opening 153) that may be used to lock the pivot bracket 124 in multiple positions.

Figure 21:
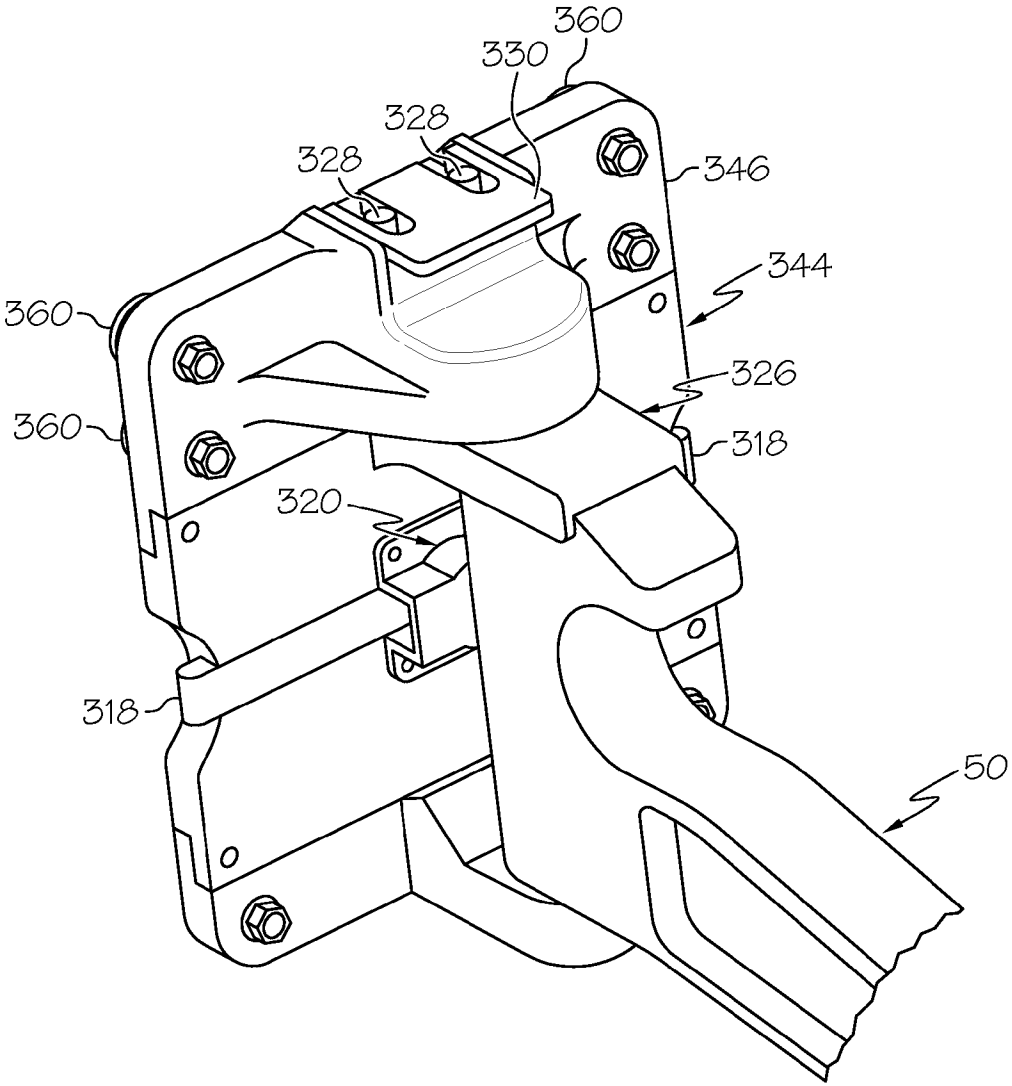
FIG. 21 is a perspective view of another exemplary embodiment of a mounting bracket for use with a support arm assembly.
Figure 22:
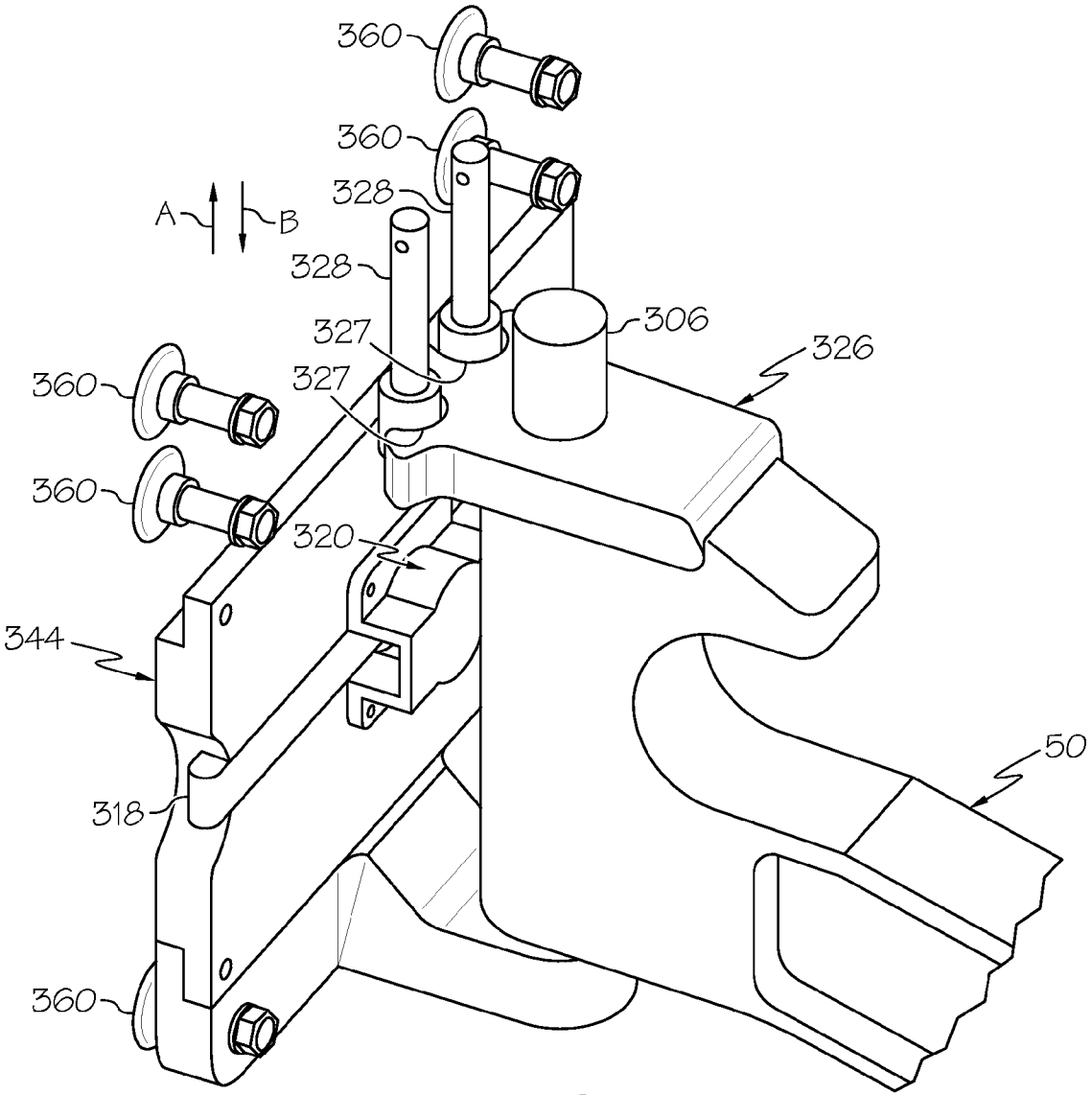
FIG. 22 is a perspective view of the exemplary embodiment of a mounting bracket of FIG. 22 for use with a support arm assembly.
Figure 23:
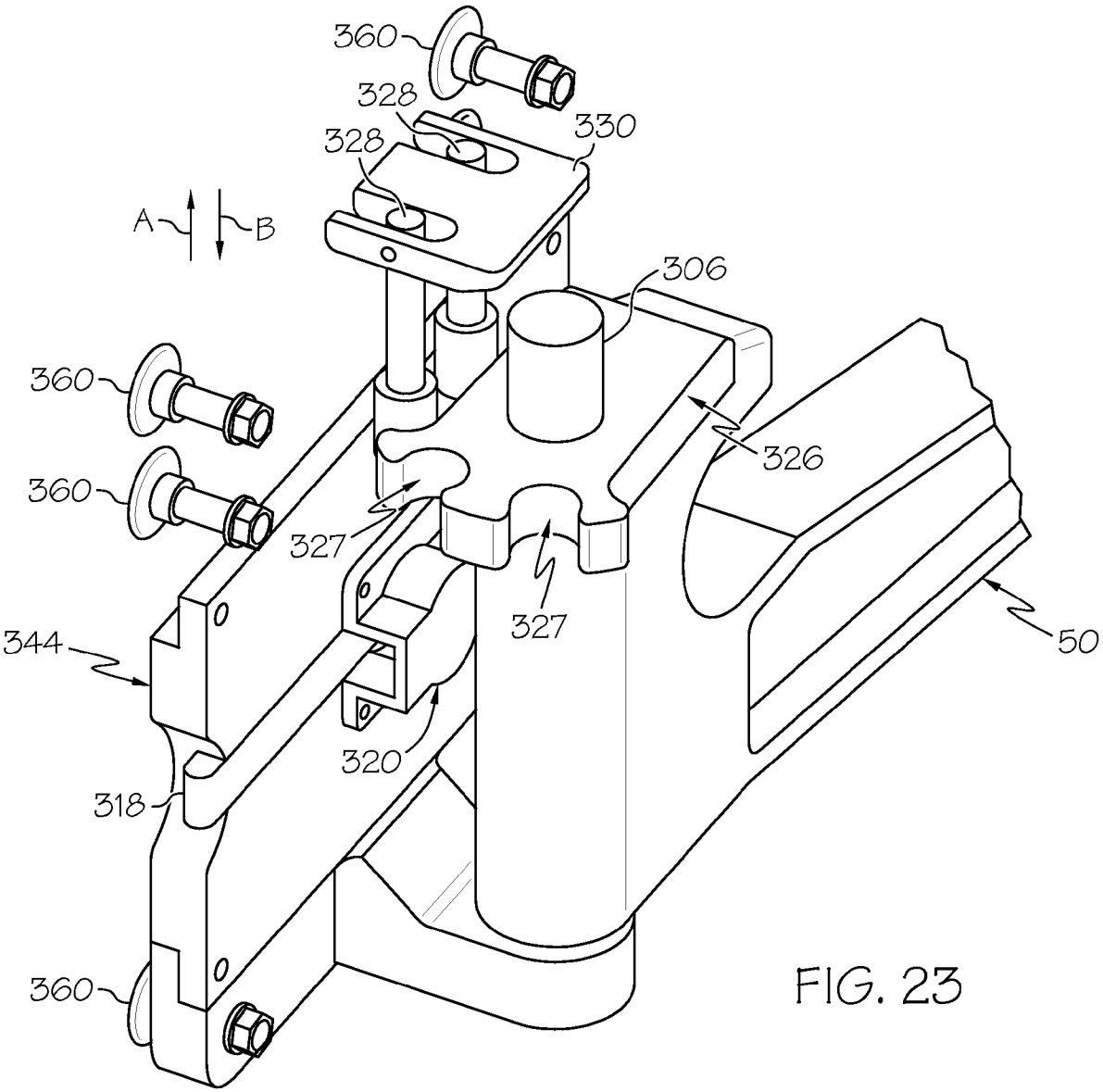
FIG. 23 is a perspective view of the exemplary embodiment of a mounting bracket of FIG. 22 for use with a support arm assembly.

Referring now to FIGS. 21-23, in another embodiment, a paddle latch pivot bracket 326 may be provided for releasable locking the rotational movement of the arm portion 50 relative the mounting bracket 344. FIG. 21 depicts a paddle latch pivot bracket 326 with a face plate 346. FIGS. 22 and 23 depict a paddle latch pivot bracket 326 with the faceplate 346 removed to better show the pivot pin 306 and the one or more recesses 327 as well as the locking pins 328. The paddle latch pivot bracket 326 may be mounted to or otherwise secured with a pivot pin 306 (which enables rotational movement of the arm portion 50). The paddle latch pivot bracket 326 may comprise one or more recesses 327 that are configured to removably receive one or more locking pins 328. A release plate 330 may be attached to the one or more locking pins 328 and allow for the movement of the locking pins 328 in the upward direction A out of the recesses 327 and in the downward direction B into the recesses 327. For example, as best illustrated in FIG. 22, when the locking pins 328 are disposed within the recesses 327 of the paddle latch pivot bracket 326, the locking pins 328 prevent rotational movement of the paddle latch pivot bracket 326 which in turn prevents rotational movement of the mounting arm 50 relative the mounting bracket 344. As best illustrated in FIG. 23, an operator may then actuate the release plate 330 to lift the locking pins 328 out of the recesses 327 in the upward direction A. The removal of the one or more locking pins 328 from the one or more recesses allows for uninhibited movement of the paddle latch pivot bracket 326 and the mounting arm 50. The locking pins 328 may then be lowered in the downward direction B to re-engage the one or more recesses 327 and thereby prevent rotational movement of the mounting arm 50. In one embodiment, the one or more locking pins 328 may be biased in the downward direction by a spring or the like. In such an embodiment, the one or more locking pins 328 may return to the one or more recesses once the an operator releases the release plate 330. In another embodiment, the one or more locking pins 328 may only return to the one or more recesses 327 when the operator actuates the release plate in the opposite direction causing the one or more release pins to move in the downward direction B.

In one embodiment, the paddle latch pivot bracket 326 may be configured to provide a limited number of rotational positions in which the locking pins secure the paddle latch pivot bracket 326 in place. For example, the paddle latch pivot bracket 326 may be secured in either a support position wherein the arm portion 50 is substantially perpendicular with a wall such that a litter may be supported thereon (as illustrated in FIG. 22) or in a stored position wherein the arm portion 50 is substantially parallel with a wall (as illustrated in FIG. 23). The one or more recesses 327 may be configured to receive the one or more locking pins 328 when the arm portion 50 is fully rotated into one of those specified positions. However, when the arm portion is disposed in an in-between position, the one or more recesses may be out of alignment with the one or more locking pins preventing the locking pins 328 from locking the arm portion 50 in place. Such an embodiment may allow for the arm portion 50 to be locked into one of a limited number of positions to ensure a proper and consistent operation is maintained. The number of recesses 327 of the paddle latch pivot bracket 326 may be increased or decreased to adjust the number of fixed positions the arm portion 50 may be locked into via the locking pins 328.

In some embodiments, the pins 138, 140 and 150 may each include a locking feature for inhibiting unintended removal of the pins. In the illustrated embodiment, each pin 138, 140 and 150 may include retractable locking features, such as ball bearings 156 located at an end of each pin. The ball bearings 156 may be sized to interfere with retraction of the pins 138, 140 and 150 from their respective openings. In some embodiments, a retraction mechanism, such as buttons 158, is provided that can be depressed to retract the ball bearings 156 and remove the pins 138, 140 and 150.

Removal of the pin 150 may allow for pivoting of the pivot bracket 124 and the support arm 42 mounted thereto side to side relative to the mounting plate 104. Removal of the pin 140 may allow for pivoting of the support arm 42 up and down relative to the pivot bracket 124 and the mounting plate 104. In these embodiments where the support arm 42 may pivot up and down, a shaft 164 of the pin 138 may be used as a pivot shaft about which the support arm 42 can pivot up and down with the pin 140 removed. FIG. 2 illustrates an example of a downwardly pivoted support arm. For example, it may be desirable to pivot the support arm 42 downward relative to the pivot bracket 124 for stowing the support arm 42 when not in use. Any suitable stowing features (see clasps 166 and 168 of FIG. 2) may be used to secure the support arm 42 in the stowed position such as clasps, latches, ties, fasteners, etc.

Figure 12:
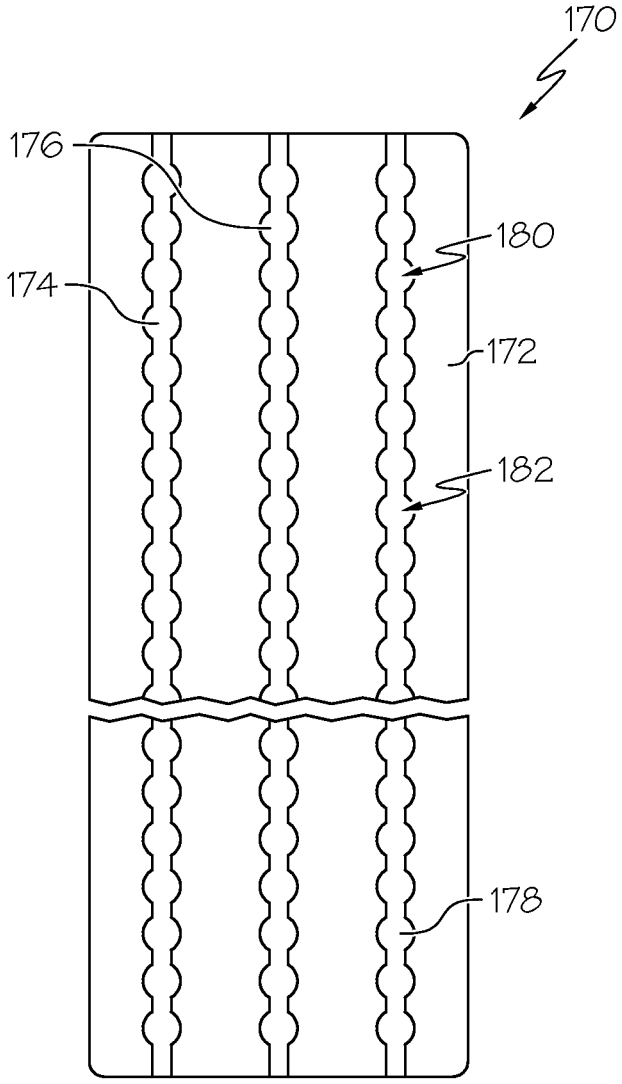
FIG. 12 is a front view of an exemplary embodiment of a track for use in the litter support system of FIG. 1.
Figure 13:
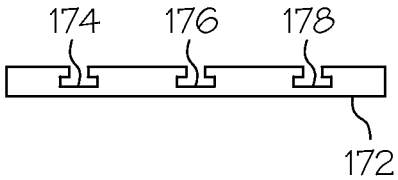
FIG. 13 is an end view of the exemplary track of FIG. 12.

Referring to FIGS. 12 and 13, an exemplary embodiment of a track 170 for use in the track system 20 or similar track system is illustrated. While two or more tracks 170 may be used in the track system 20 as illustrated by FIG. 1, only one track will be described as multiple tracks of the same track system may have the same or substantially the same features. The track 170 includes a backing plate 172 that may have an elongated, rectangular shape (or any other suitable shape) and three slots 174, 176 and 178 extending along the length of the backing plate and substantially parallel to each other. Each slot 174, 176 and 178 may have a series of enlarged open regions 180 that are adjacent to necked-down regions 182. In some embodiments, the enlarged open regions 180 are symmetrical such that they are spaced equidistant apart and are aligned in widthwise rows along the length of the backing plate 172. As another example, the enlarged open regions 180 of one or more of the slots 174, 176 and 178 may not all be equidistant and/or may not be aligned in rows with the other enlarged open regions of the other slots.

Figure 14:
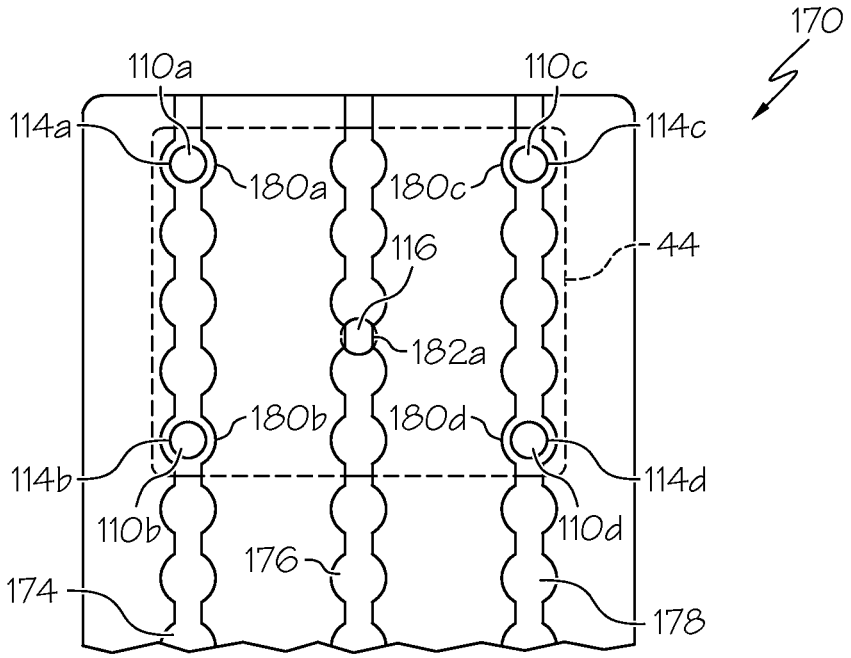
FIGS. 14 and 15 illustrate interaction between the track of FIG. 12 and the mounting bracket of FIG. 6.
Figure 15:
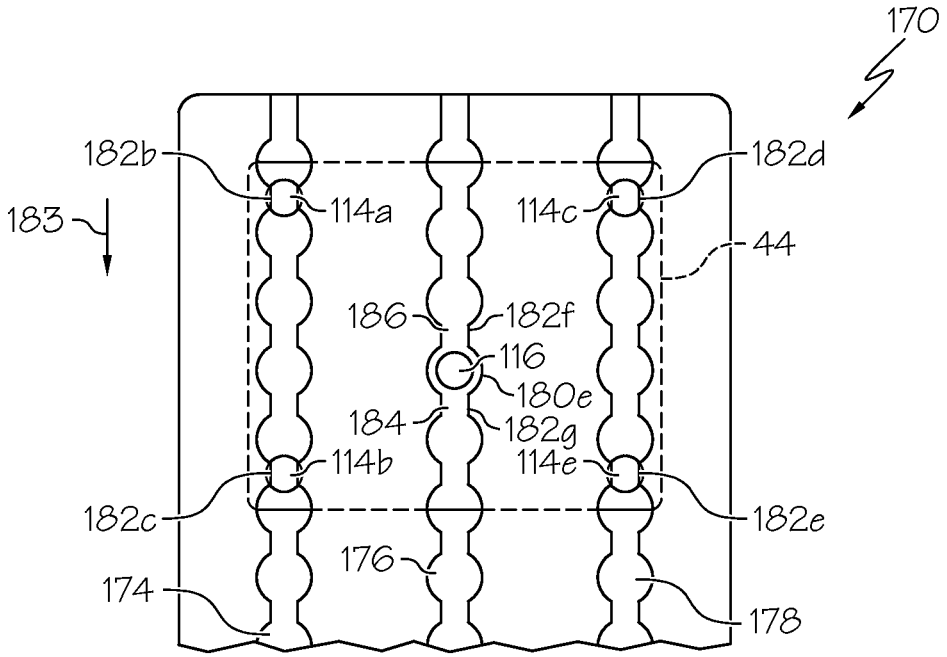

Referring to FIGS. 14 and 15, the track 170 and the mounting bracket 44 provide an out-of-phase configuration that is used to lock the mounting bracket to the track. Referring to FIG. 14, when the enlarged head portions 114*a*, 114*b*, 114*c* and 114*d* of the projections 110*a*, 110*b*, 110*c* and 110*d* of the mounting bracket 44 are inserted within the enlarged open regions 180*a*, 180*b*, 180*c* and 180*d* of the slots 174 and 178, the locking projection 116 is prevented from entering the slot 176 due to its alignment with the necked-down region 182*a*. In some embodiments, placing the enlarged head portions 114*a*, 114*b*, 114*c* and 114*d* in the slots 174 and 178 causes the locking projection 116 to retract from its outwardly biased, extended position. Referring to FIG. 15, the stem portions 112 of the projections 110*a*, 110*b*, 110*c* and 110*d* are sized to slide through the necked down regions 182 while the enlarged head portions 114*a*, 114*b*, 114*c* and 114*d* remain in the slots 174 and 178. Movement of the mounting bracket 44 downwardly in the direction of arrow 183 aligns the enlarged head portions 114*a*, 114*b*, 114*c* and 114*d* with necked-down regions 182*b*, 182*c*, 182*d* and 182*e* of the slots 174 and 178 and aligns the locking projection 116 with the enlarged open region 180*e* of the slot 176. The width of the locking projection 116 may be greater than the passageways 184 and 186 through the necked-down regions 182*f* and 182*g* adjacent the enlarged open region 180*e*, which prevents further movement of the mounting bracket 44 once the locking projection passes through the enlarged open region 180*e* and into the slot 176. In embodiments where the locking projection 116 is biased toward its extended position, the locking projection may snap into its extended position automatically once the locking projection is aligned with the enlarged open region 180*e*. An operator can retract the locking projection 116 out of the slot 176 by actuating the lever 118 as described above and again move the mounting bracket 44 along the track 170 to a different elevation.

While FIGS. 14 and 15 illustrate a mounting bracket being secured to the track using four projections 110*a*, 110*b*, 110*c*, and 110*d* and one locking projection 116, it should be appreciated that any other number of projections and locking projections may alternatively be employed. For example, as illustrated in FIG. 21-23, in one embodiment the mounting bracket 344 may use six projections 360 wherein two projections 360 are disposed on a bottom portion and four projections 360 are disposed on a top portion. Such an embodiment may allow for a secured connection under increased loads by providing more points of contact between the mounting bracket 344 and the track. In another embodiment, the mounting bracket may incorporate eight projections evenly distributed about the mounting bracket. In yet another embodiment, any other number of projections may be disposed on the mounting bracket that allows for a releasable connection with the track.

Figure 16:
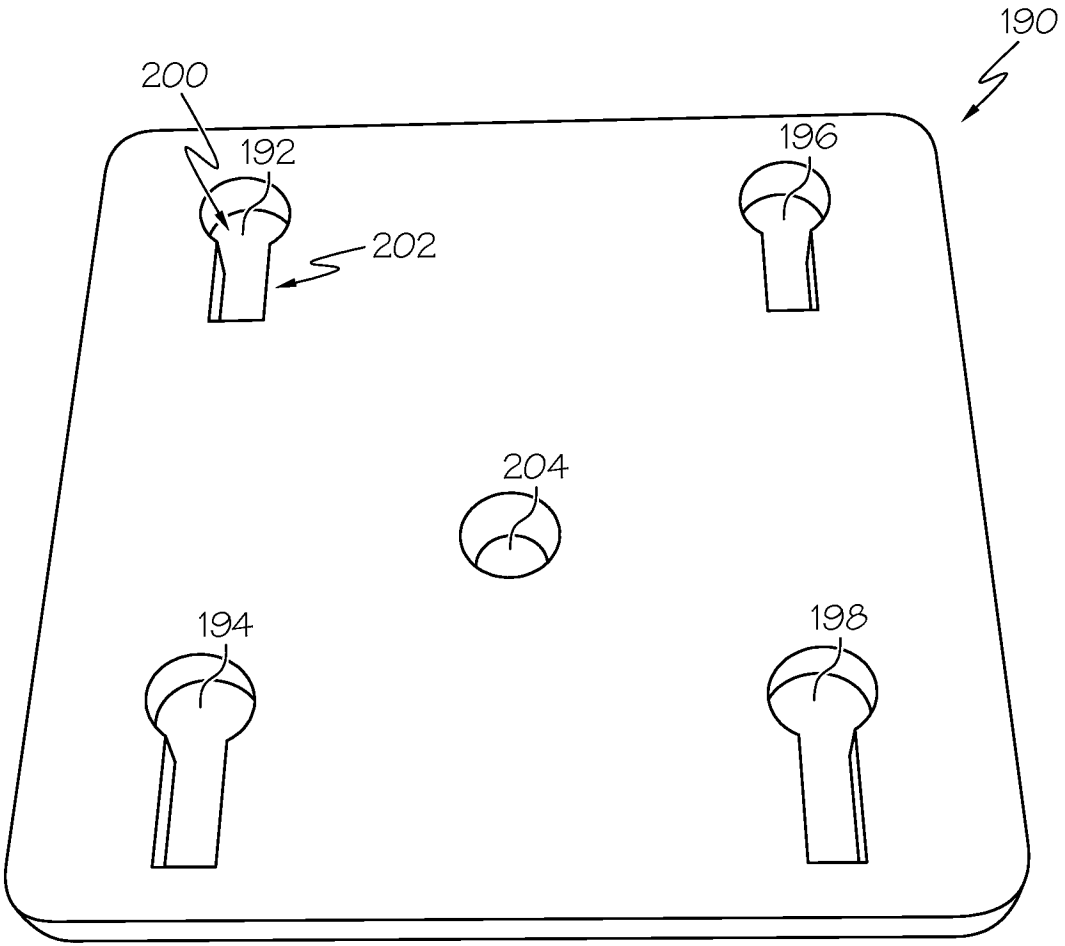
FIG. 16 is a perspective front view of an exemplary embodiment of a mounting plate.

Referring to FIG. 16, as an alternative to the track 170, an exemplary mounting plate 190 may be used to mount the mounting bracket 44 of the arm support assembly 40 to a wall. The mounting plate 190 may include any suitable mount structure for mounting to a wall. The mounting plate 190 includes slots in the form of keyhole slots 192, 194, 196 and 198 that have an enlarged portion 200 and a necked-down portion 202. The enlarged portions 200 of the keyhole slots 192, 194, 196 and 198 are sized and arranged to receive the enlarged head portions 114 therethrough and the necked-down portions 202 are sized to allow the stem portions 112 to slide therein with the enlarged head portions captured within the keyhole slots. An opening 204 may be provided that is sized to receive the locking projection 116 when the locking projection is aligned with the opening 204.

Figure 18:
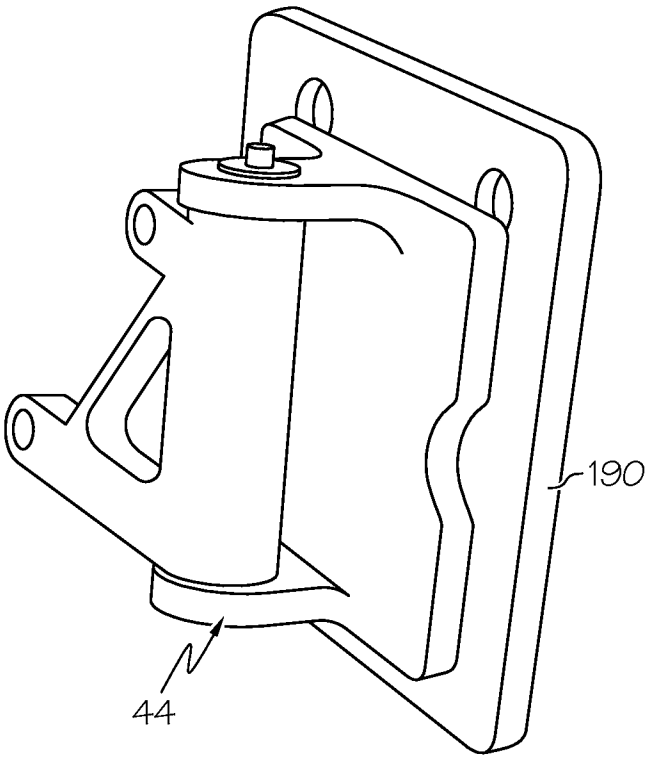
FIGS. 17 and 18 illustrate interaction between the mounting plate of FIG. 16 and the mounting bracket of FIG. 6.
Figure 17:
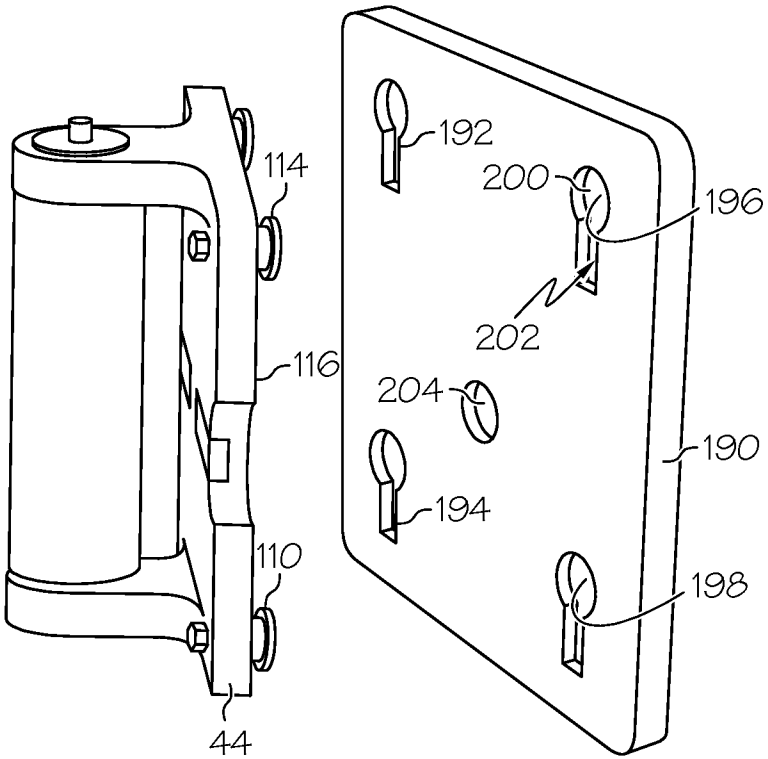

FIGS. 17 and 18 illustrate locking the mounting bracket 44 to the mounting plate 190. In FIG. 17, the enlarged head portions 114 are inserted into the enlarged portions 200 of the keyhole slots 192, 194, 196 and 198, which may retract the locking projection 116. Referring to FIG. 18, the mounting bracket 44 may then be moved in a downward direction to place the enlarged head portions 114 behind the necked-down portions 202 and to extend the locking projection 116 into the opening 204 thereby locking the mounting bracket 44 to the mounting plate 190. In some embodiments, the mounting plate 190 may be fixedly mounted to a wall along with other mounting plates 190 to provide the mounting structure for the arm support assemblies 40.

Figure 19:
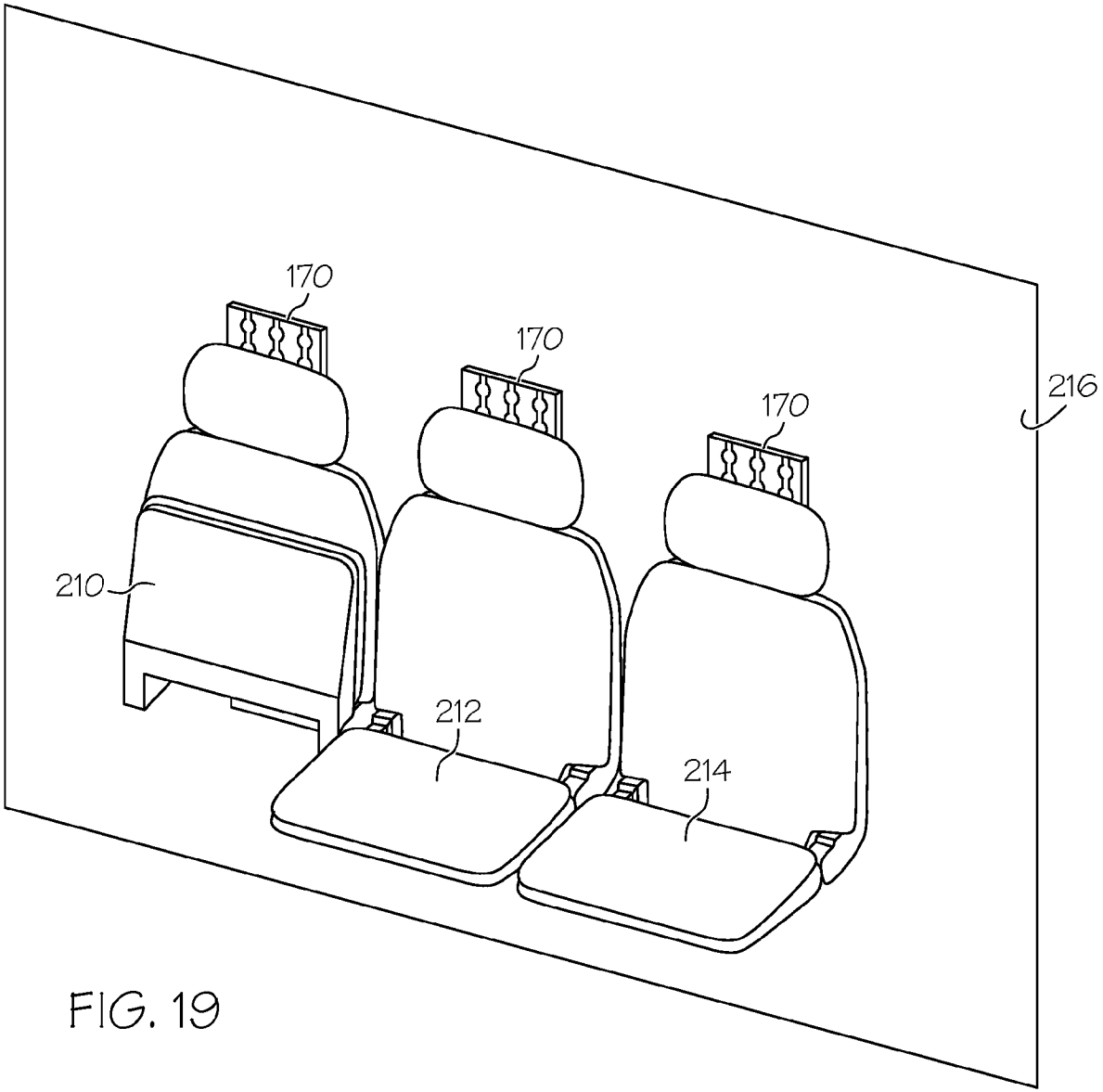
FIG. 19 is a perspective view of an exemplary embodiment of a mounting arrangement for mounting seats using the track of FIG. 12 and the mounting bracket of FIG. 6.

Referring to FIG. 19, mounting brackets (e.g., mounting brackets having a similar mounting structure to mounting bracket 44) may be used to mount various components, for example, to the tracks 170 or to the mounting plate 190. FIG. 19 illustrates an example where seats 210, 212 and 214 are mounted to a wall 216 in a position elevated from a floor. The elevations of the seats may be adjustable along or removable from the tracks 170 in a fashion similar to that described above.

Figure 20:
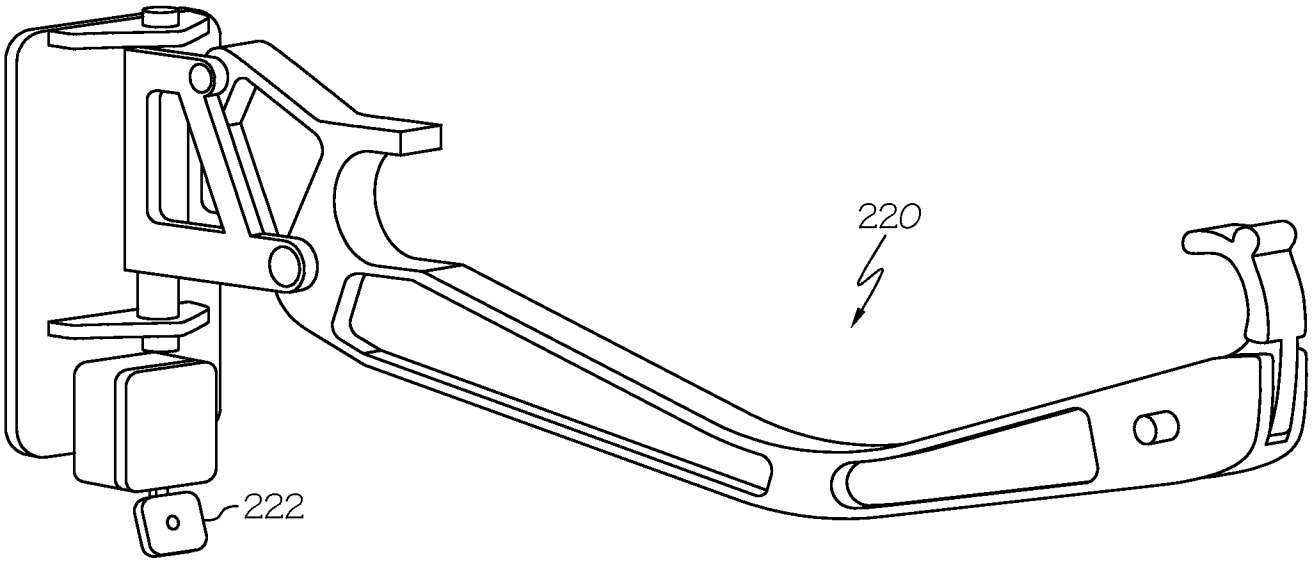
FIG. 20 illustrates another exemplary embodiment of a support arm assembly for use in the litter support system of FIG. 1.

Referring to FIG. 20, another embodiment of a support arm assembly 220 includes many of the features described above with reference to support arm assembly 40. In this embodiment, a release trigger 222 is provided for releasing a locking projection (not shown) so that the support arm assembly 220 can be moved up and down the track 30 in a fashion similar to that described above.

The litter support system 10 described above may provide a modular, adjustable litter support system, capable of planned or unplanned adjustments to accommodate a variety of emergency circumstances, whether foreseen or unforeseen. The litter support system 10 may provide a number of configurations for supporting one ore more litters carrying patients or other persons within vehicles and for stowing or even removing components of the support system when not in use. The litter support system 10 may adjust to accommodate litters of various sizes.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A support arm assembly for a litter support system that is configured to support a patient in a horizontal elevated position, the support arm assembly comprising:

an arm portion comprising a free end and an attachment end, wherein the attachment end is configured to secure the support arm assembly to an attachment structure for supporting the arm portion at a selected height and wherein the attachment end is configured to allow the support arm assembly to transition between a stored position and a support position when secured to a wall;

an exterior hook disposed at the free end of the arm portion, the exterior hook being adjustable relative to the arm portion between open and closed positions to secure side shafts of various litters where the various litters have different widths and/or the side shafts of the various litters have different diameters;

a mounting bracket connected to the attachment end of the support arm assembly, the mounting bracket providing the support arm assembly with a first pivot location allowing for pivoting of the support arm assembly relative to the mounting bracket about a vertical axis between the stored position and the support position, the mounting bracket providing the support arm assembly with a second pivot location allowing for pivoting of the support arm assembly relative to the mounting bracket about a horizontal axis between lowered and raised positions; and one or more locking projections sized and configured to be received by the mounting bracket to lock the support arm assembly in one or more of the stored, support, lowered and raised positions relative to the mounting bracket.

2. The support arm assembly of claim 1 wherein the exterior hook is adjustable via a ratchet assembly operatively connected to the exterior hook.

3. The support assembly of claim 2, wherein the ratchet assembly is configured to prevent opening of the exterior hook at a plurality of angular, closed positions.

4. The support assembly of claim 3, wherein the ratchet assembly comprises a gearwheel including a plurality of teeth extending about a periphery of the gearwheel and a pawl that is movably biased toward the gearwheel.

5. The support assembly of claim 4 further comprising a trigger connected to the pawl, wherein actuation of the trigger moves the pawl out of engagement with at least one of the plurality of teeth.

6. The support assembly of claim 5, wherein the exterior hook is biased toward the open position such that actuation of the trigger causes the exterior hook to move toward the open position.

7. The support arm assembly of claim 1 further comprise an interior hook disposed along the arm portion and facing the exterior hook.

8. The support arm assembly of claim 7, wherein the interior hook is fixed relative to the arm portion.

9. The support arm assembly of claim 8 wherein the arm portion comprises a recession portion between the exterior hook and the interior hook such that the recessed portion is offset vertically from the exterior hook and the interior hook.

10. The support arm assembly of claim 1, wherein the arm portion has a longitudinal axis, and wherein the exterior hook is adjustable relative to the arm portion along the longitudinal axis of the arm portion.

11. A support arm assembly for a litter support system that is configured to support a patient in a horizontal elevated position, the support arm assembly comprising:

an arm portion comprising a free end and an attachment end, wherein the attachment end is configured to secure the support arm assembly to an attachment structure for supporting the arm portion at a selected height wherein the attachment end is configured to allow the support arm assembly to transition between a stored position and a support position when secured to a wall and wherein the attachment end comprises a paddle latch pivot bracket for locking the rotational movement of the support arm assembly relative the mounting bracket, wherein the paddle latch pivot bracket comprises one or more recesses configured to removably receive one or more locking pins, and wherein the locking pins releasably lock the support arm assembly in the stored position or in the support position when in the one or more recesses of the paddle latch pivot bracket;

an exterior hook disposed at the free end of the arm portion, the exterior hook being adjustable relative to the arm portion between open and closed positions to secure side shafts of various litters where the various litters have different widths and/or the side shafts of the various litters have different diameters; and a mounting bracket connected to the attachment end of the support arm assembly, the mounting bracket providing the support arm assembly with a first pivot location allowing for pivoting of the support arm assembly relative to the mounting bracket about a vertical axis between the stored position and the support position, the mounting bracket providing the support arm assembly with a second pivot location allowing for pivoting of the support arm assembly relative to the mounting bracket about a horizontal axis between lowered and raised positions.

12. The support arm assembly of claim 11, wherein the exterior hook is adjustable via a ratchet assembly operatively connected to the exterior hook.

13. The support assembly of claim 12, wherein the ratchet assembly is configured to prevent opening of the exterior hook at a plurality of angular, closed positions.

14. The support assembly of claim 13, wherein the ratchet assembly comprises a gearwheel including a plurality of teeth extending about a periphery of the gearwheel and a pawl that is movably biased toward the gearwheel.

15. The support assembly of claim 14, further comprising a trigger connected to the pawl, wherein actuation of the trigger moves the pawl out of engagement with at least one of the plurality of teeth.

16. The support assembly of claim 15, wherein the exterior hook is biased toward the open position such that actuation of the trigger causes the exterior hook to move toward the open position.

17. The support arm assembly of claim 11, further comprising an interior hook disposed along the arm portion and facing the exterior hook.

18. The support arm assembly of claim 17, wherein the interior hook is fixed relative to the arm portion.

19. The support arm assembly of claim 18, wherein the arm portion comprises a recessed portion between the exterior hook and the interior hook such that the recessed portion is offset vertically from the exterior hook and the interior hook.

20. A litter support system comprising:

a first vertical track comprising a first plurality of incremental securement locations;

a first mounting bracket configured to secure to any of the first plurality of incremental securement locations of the first vertical track;

a first support arm assembly comprising a first arm portion comprising a first free end and a first attachment end, wherein the first attachment end is connected to the mounting bracket;

a second vertical track comprising a second plurality of incremental securement locations, the second vertical track being substantially parallel with the first vertical track;

a second mounting bracket configured to secure to any of the second plurality of incremental securement locations of the second vertical track; and a second support arm assembly comprising a second arm portion comprising a second free end and a second attachment end, wherein the second attachment end is connected to the second mounting bracket, wherein the first mounting bracket engages the first vertical track such that the first arm assembly can move from a first vertical position to a second vertical position along the first vertical track without having to disengage the first mounting bracket from the first vertical track, and wherein the second mounting bracket engages the second vertical track such that the second arm assembly can move from a first vertical position to a second vertical position along the second vertical track without having to disengage the second mounting bracket from the second vertical track and wherein the first support arm assembly comprises a first interior hook disposed along the first arm portion to receive a side shaft of a litter and a first exterior hook connected to the first free end and facing the first interior hook to receive an opposite side shaft of the litter; and the second support arm assembly comprises a second interior hook disposed along the second arm portion to receive the side shaft of the litter and a second exterior hook connected to the second free end and facing the second interior hook to receive the opposite side shaft of the litter.

21. The litter support system of claim 20 wherein the first vertical track and the second vertical track each comprise:

a first vertical plurality of securement slots, wherein each securement slot comprises an enlarged head portion adjacent a necked-down region, such that an enlarged head of a mounting projection of the first mounting bracket may pass through the enlarged head portion to allow a stem connected to the enlarged head to slide down the necked-down region such that the enlarged head cannot be removed through the necked-down region; and a second vertical plurality of securement slots in parallel with the first vertical plurality of securement slots, where each of the second vertical plurality of securement slots are horizontally aligned with the first vertical plurality of securement slots such that the first vertical plurality of securement slots and the second vertical plurality of securement slots can simultaneously receive a pair of horizontally aligned mounting projections.

22. The litter support system of claim 20 wherein:

the first vertical track further comprises a first plurality of openings operable to receive a first locking projection of the first mounting bracket when the first mounting bracket is secured to any of the first plurality of incremental securement locations; and the second vertical track further comprises a second plurality of openings operable to receive a second locking projection of the second mounting bracket when the second mounting bracket is secured to any of the second plurality of incremental securement locations.

23. The litter support system of claim 22 wherein:

the first locking projection is released from the first plurality of openings by a first lever prior to moving the first mounting bracket from one of the first plurality of securement locations to another of the first plurality of securement locations; and the second locking projection is released from the second plurality of openings by a second lever prior to moving the second mounting bracket from one of the second plurality of securement locations to another of the second plurality of securement locations.

24. The litter support system of claim 20 wherein the first exterior hook and the second exterior hook are each adjustable relative to their respective first and second arm portions along respective longitudinal axes of the first and second arm portions to secure side shafts of varying diameters.

25. The litter support system of claim 24 wherein the first exterior hook is adjustable via a first ratchet assembly operatively connected to the first exterior hook and the second exterior hook is adjustable via a second ratchet assembly operatively connected to the second exterior hook.

26. A litter support system comprising:

a first vertical track comprising a first plurality of incremental securement locations;

a first mounting bracket configured to secure to any of the first plurality of incremental securement locations of the first vertical track;

a first support arm assembly comprising a first arm portion comprising a first free end and a first attachment end, wherein the first attachment end is connected to the mounting bracket and wherein the connection between the first attachment end and the first mounting bracket is configured to allow the first support arm assembly to move between a first stored position and a first support position and the connection between the second attachment end and the second mounting bracket is configured to allow the second support arm assembly to transition between a second stored position and a second support position;

a second vertical track comprising a second plurality of incremental securement locations, the second vertical track being substantially parallel with the first vertical track;

a second mounting bracket configured to secure to any of the second plurality of incremental securement locations of the second vertical track; and a second support arm assembly comprising a second arm portion comprising a second free end and a second attachment end, wherein the second attachment end is connected to the second mounting bracket, wherein the first mounting bracket engages the first vertical track such that the first arm assembly can move from a first vertical position to a second vertical position along the first vertical track without having to disengage the first mounting bracket from the first vertical track, and wherein the second mounting bracket engages the second vertical track such that the second arm assembly can move from a first vertical position to a second vertical position along the second vertical track without having to disengage the second mounting bracket from the second vertical track and wherein the first support arm assembly comprises a first interior hook disposed along the first arm portion to receive a side shaft of a litter and a first exterior hook connected to the first free end and facing the first interior hook to receive an opposite side shaft of the litter; and the second support arm assembly comprises a second interior hook disposed along the second arm portion to receive the side shaft of the litter and a second exterior hook connected to the second free end and facing the second interior hook to receive the opposite side shaft of the litter.

27. The litter support system of claim 26, wherein the first vertical track and the second vertical track each comprise:

a first vertical plurality of securement slots, wherein each securement slot comprises an enlarged head portion adjacent a necked-down region, such that an enlarged head of a mounting projection of the first mounting bracket may pass through the enlarged head portion to allow a stem connected to the enlarged head to slide down the necked-down region such that the enlarged head cannot be removed through the necked-down region; and a second vertical plurality of securement slots in parallel with the first vertical plurality of securement slots, where each of the second vertical plurality of securement slots are horizontally aligned with the first vertical plurality of securement slots such that the first vertical plurality of securement slots and the second vertical plurality of securement slots can simultaneously receive a pair of horizontally aligned mounting projections.

28. The litter support system of claim 26, wherein:

the first vertical track further comprises a first plurality of openings operable to receive a first locking projection of the first mounting bracket when the first mounting bracket is secured to any of the first plurality of incremental securement locations; and the second vertical track further comprises a second plurality of openings operable to receive a second locking projection of the second mounting bracket when the second mounting bracket is secured to any of the second plurality of incremental securement locations.

29. The litter support system of claim 28, wherein:

the first locking projection is released from the first plurality of openings by a first lever prior to moving the first mounting bracket from one of the first plurality of securement locations to another of the first plurality of securement locations; and the second locking projection is released from the second plurality of openings by a second lever prior to moving the second mounting bracket from one of the second plurality of securement locations to another of the second plurality of securement locations.

30. The litter support system of claim 26, wherein the first exterior hook and the second exterior hook are each adjustable relative to their respective first and second arm portions along respective longitudinal axes of the first and second arm portions to secure side shafts of varying diameters.

31. The litter support system of claim 30, wherein the first exterior hook is adjustable via a first ratchet assembly operatively connected to the first exterior hook and the second exterior hook is adjustable via a second ratchet assembly operatively connected to the second exterior hook.

32. A support arm assembly for a litter support system that is configured to support a patient in a horizontal elevated position, the support arm assembly comprising:

an arm portion comprising a free end and an attachment end, wherein the attachment end is configured to secure the support arm assembly to an attachment structure for supporting the arm portion at a selected height, wherein the attachment end is configured to allow the support arm assembly to transition between a stored position and a support position when secured to a wall;

an exterior hook disposed at the free end of the arm portion, the exterior hook being adjustable relative to the arm portion between open and closed positions to secure side shafts of various litters where the various litters have different widths and/or the side shafts of the various litters have different diameters;

a mounting bracket connected to the attachment end, the mounting bracket providing the support arm assembly with a first pivot location allowing for pivoting of the support arm assembly relative to the mounting bracket about a vertical axis between the stored position and the support position, the mounting bracket providing the support arm assembly with a second pivot location allowing for pivoting of the support arm assembly relative to the mounting bracket about a horizontal axis between lowered and raised positions; and one or more pins sized to be received by the support arm, the mounting bracket, or both to lock the support arm assembly in one or more of the stored, support, lowered and raised positions relative to the mounting bracket.

33. A support arm assembly for a litter support system that is configured to support a patient in a horizontal elevated position, the support arm assembly comprising:

an arm portion comprising a free end and an attachment end, wherein the attachment end is configured to secure the support arm assembly to an attachment structure for supporting the arm portion at a selected height, wherein the attachment end is configured to allow the support arm assembly to transition between a stored position and a support position when secured to a wall;

an exterior hook disposed at the free end of the arm portion, the exterior hook being adjustable relative to the arm portion between open and closed positions to secure side shafts of various litters where the various litters have different widths and/or the side shafts of the various litters have different diameters; and a mounting bracket connected to the attachment end of the support arm assembly, the mounting bracket providing the support arm assembly with a first pivot location allowing for pivoting of the support arm assembly relative to the mounting bracket about a vertical axis between the stored position and the support position, the mounting bracket providing the support arm assembly with a second pivot location allowing for pivoting of the support arm assembly relative to the mounting bracket about a horizontal axis between lowered and raised positions, wherein:

the attachment end of the arm portion comprises a paddle latch pivot bracket for locking the rotational movement of the support arm assembly relative the mounting bracket, the paddle latch pivot bracket comprises one or more recesses configured to removably receive one or more locking pins, and the locking pins releasably lock the support arm assembly in the stored position or in the support position when in the in one or more recesses of the paddle latch pivot bracket.

* * * * *